US008561666B2

(12) United States Patent
MacAllen et al.

(10) Patent No.: US 8,561,666 B2
(45) Date of Patent: Oct. 22, 2013

(54) FLEXIBLE FURNITURE SYSTEM

(75) Inventors: Todd P. MacAllen, Vancouver (CA); Stephanie P. Forsythe, Vancouver (CA)

(73) Assignee: molo design, ltd., Vancouver (CA)

( * ) Notice: Subject to any disclaimer, the term of this patent is extended or adjusted under 35 U.S.C. 154(b) by 109 days.

(21) Appl. No.: 12/646,822

(22) Filed: Dec. 23, 2009

(65) Prior Publication Data

US 2010/0186905 A1 Jul. 29, 2010

Related U.S. Application Data

(63) Continuation-in-part of application No. 12/343,042, filed on Dec. 23, 2008, which is a continuation-in-part of application No. 11/742,984, filed on May 1, 2007, now Pat. No. 7,866,366, which is a continuation-in-part of application No. 11/287,195, filed on Nov. 28, 2005, now abandoned.

(60) Provisional application No. 60/681,972, filed on May 18, 2005.

(30) Foreign Application Priority Data

Nov. 25, 2005 (CA) ..... 2527927

(51) Int. Cl.
*A47H 5/00* (2006.01)

(52) U.S. Cl.
USPC .... 160/84.05; 160/135; 160/351; 108/157.14

(58) Field of Classification Search
USPC ..... 160/84.04, 84.05, 84.06, 351, 352, 135, 160/113, 114; 410/154; 428/116, 118, 178; 52/793.11, 793.1, 28, DIG. 28; 362/352, 353, 249.04, 249.06, 565, 362/551; 297/440.14; 156/197; 40/563
See application file for complete search history.

(56) References Cited

U.S. PATENT DOCUMENTS 2,101,836 A 12/1937 Benedict
2,324,398 A 7/1943 Kahr (Continued)

FOREIGN PATENT DOCUMENTS

CA 1166951 5/1984
CA 2586759 11/2008

(Continued)

OTHER PUBLICATIONS

Pedersen, Martin C.; "The Soft House"; Metropolis Magazine; Jul. 2004; New York.

(Continued)

*Primary Examiner* — Blair M. Johnson
(74) *Attorney, Agent, or Firm* — John R. S. Orange; Blake, Cassels & Graydon LLP.

(57) ABSTRACT

An article of flexible furniture having a core formed from a plurality of laminar panels of a flaccid material and each panel having a pair of oppositely directed major faces, adjacent faces of said panels being inter-connected to provide a cellular structure upon movement of abutting faces away from each other, a pair of supports at opposite ends of said core and connected to respective ones of said faces, said supports being self-supporting to provide rigidity to said core whereby said supports may be moved apart to expand said cellular and extend the length of said partition.

25 Claims, 41 Drawing Sheets

(56) References Cited

U.S. PATENT DOCUMENTS

| | | | | | |
|---|---|---|---|---|---|
| 2,346,824 | A | * | 4/1944 | Cohen | 428/10 |
| 3,170,831 | A | | 2/1965 | Paige | |
| 3,975,882 | A | * | 8/1976 | Walter | 52/571 |
| 4,052,828 | A | * | 10/1977 | Mancini et al. | 52/242 |
| 4,209,162 | A | | 6/1980 | Petiau | |
| 4,671,334 | A | | 6/1987 | Yadegar et al. | |
| 4,694,144 | A | | 9/1987 | Delaroche et al. | |
| 4,733,711 | A | | 3/1988 | Schon | |
| 4,934,434 | A | | 6/1990 | Schnebly et al. | |
| 4,970,831 | A | | 11/1990 | Rota | |
| 5,078,195 | A | | 1/1992 | Schon | |
| 5,193,601 | A | | 3/1993 | Corey et al. | |
| 5,373,916 | A | * | 12/1994 | Kiviniemi et al. | 187/336 |
| 5,406,760 | A | | 4/1995 | Edwards | |
| 5,690,778 | A | | 11/1997 | Swiszcz et al. | |
| 6,019,864 | A | * | 2/2000 | Jones | 156/258 |
| 6,283,191 | B1 | * | 9/2001 | Lo | 160/84.02 |
| 6,427,409 | B2 | * | 8/2002 | Colson et al. | 52/506.08 |
| 6,431,936 | B1 | | 8/2002 | Kiribuchi | |
| 6,527,895 | B1 | | 3/2003 | Palmer | |
| 6,764,200 | B1 | | 7/2004 | Wu Liu | |
| 6,959,752 | B2 | | 11/2005 | Huang | |
| 7,866,366 | B2 | * | 1/2011 | MacAllen et al. | 160/84.05 |
| 2001/0009179 | A1 | | 7/2001 | Huang | |
| 2002/0179558 | A1 | | 12/2002 | Venegas, Jr. | |
| 2003/0156426 | A1 | | 8/2003 | Givoletti | |
| 2006/0082987 | A1 | | 4/2006 | Dorsey et al. | |
| 2006/0260231 | A1 | | 11/2006 | MacAllen et al. | |

FOREIGN PATENT DOCUMENTS

| | | | |
|---|---|---|---|
| WO | WO 2005/056899 | A1 | 6/2005 |
| WO | WO 2007/048951 | A1 | 5/2007 |
| WO | WO 2008/144537 | A | 11/2008 |

OTHER PUBLICATIONS

Dempster, Victoria; PCT International Search Report PCT/CA2009/001903; Apr. 19, 2010.

http://www.balkanyug.bg/new/index.php?page=shop.browse&category_id=103&option=com_virtuemart&Itemid=4—products of Balcan Yug OOD from Haskovo, Bulgaria; retrieved from the Internet May 1, 2013.

http://www.lessocenter.com/products-49.html—products of Lesoncentar OOD, Trojan, Bulgaria; retrieved from the Internet May 1, 2013.

http://kori-vrati.g-m.bg/—products of G&M from Varna, Bulgaria; retrieved from the Internet May 1, 2013.

Timmyvirus111; "Flexible Love" Folding Chair; http://www.youtube.com/watch?v=LbEEXMlhZR0; retrieved from the Internet May 1, 2013.

Rushtang72; Paper Sofa Folding Chair Carton Furniture; http://www.youtube.com/watch?v=8s5cWX6QyBs; retrieved from the Internet May 1, 2013.

Paparazzia; Folding Chair; http://www.youtube.com/watch?v=t9dNbQCHfMc; retrieved from the Internet May 1, 2013.

ONETWO easy-2-do event furniture; Product Catalogue 2005.

Acknowledgment of receipt of observations by third parties (Art. 115 EPC); issued in corresponding EP Patent Application No. EP09833988; dated Jun. 15, 2011.

* cited by examiner (a)

FLEXIBLE FURNITURE SYSTEM

CROSS-REFERENCE TO RELATED APPLICATIONS

This application is a continuation-in-part of U.S. patent application Ser. No. 12/343,042 filed on Dec. 23, 2008 which is a continuation-in-part of U.S. patent application Ser. No. 11/742,984 filed on May 1, 2007 now U.S. Pat. No. 7,866,366 which is a continuation-in-part of U.S. patent application Ser. No. 11/287,195 filed on Nov. 28, 2005 now abandoned which claims priority from Canadian Patent Application No. 2,527,927 filed on Nov. 25, 2005 and U.S. Provisional Application No. 60/681,972 filed on May 18, 2005 all of which are incorporated herein by reference.

FIELD OF THE INVENTION

The present invention relates to flexible furniture components and methods of making such components.

DESCRIPTION OF THE PRIOR ART

Furniture is a staple product used in domestic, working and public environments. Furniture may be used to facilitate the use of space, such as in a seat or table, or to divide space, such as in a partition. By way of example, partitions are frequently used to subdivide spaces, or to create more intimate spaces. Typically such partitions are rigid, or have rigid frames, or are formed from rigid interconnected panels and they are relatively large, heavy, and cumbersome, and therefore difficult to set-up, take down, store, and transport. Similarly other items of furniture, such as seating structures, are typically of a rigid, or permanent nature that, at most, are moveable to alternative locations.

Moreover, the inherent rigidity of such items of furniture limits the extent to which they can be dynamically resized (extended or contracted) and reshaped to suit varying spaces and requirements, or readily moved around for relocation, or storage.

Additionally, such furniture items, particularly in the form of partitions are typically formed from opaque panels which inhibit the transmission of light, therefore necessitating increased use of, or rearrangement of artificial lighting to restore adequate lighting levels.

In domestic, working, and public environments it is frequently desirable to be able to subdivide and reshape space on a temporary basis. For example, visitors may require a temporary sitting or sleeping area, office workers may need to convert an open plan area into subdivided working space or temporary meeting space, trade show participants may need to demarcate a temporary display area, and designers may need to create and shape a temporary area for an event, or a backdrop for a designed area, such as in a window display in a retail setting, in a showroom, or in a theatrical setting. For these types of applications, furniture components that are rigid, heavy, and/or cumbersome may be costly to transport, difficult to set up/take down, and may require significant storage space. Furniture in the form of a partition that is rigid will also place significant constraints on the ways in which a given space can be partitioned, limiting its functionality, and a partition that is fully opaque will severely disturb natural lighting.

It is therefore an object of the present invention to provide articles of furniture in which the above disadvantages are obviated or mitigated.

SUMMARY OF THE INVENTION

According therefore to one aspect of the present invention there is provided an article of furniture having a core formed from a plurality of laminar panels of a flexible flaccid material. Each panel has a pair of oppositely-directed major faces with faces of adjacent panels being inter-connected to provide a cellular structure upon movement of the faces away from each other. A respective one of a pair of supports is provided at opposite ends of the core and connected to respective ones of the faces. The supports are self-supporting to provide rigidity to the article of furniture and/or to provide connectivity between like articles of furniture. In this way, the supports may be moved apart to expand the cellular structure and extend the overall length of the article of furniture, and/or be used to connect any of more than one of such articles together in series.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
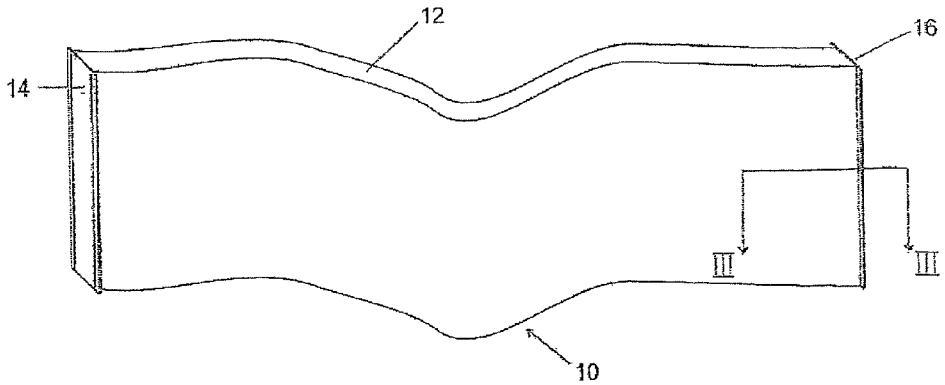
FIG. 1 is a front perspective view of a partition.
Figure 2:
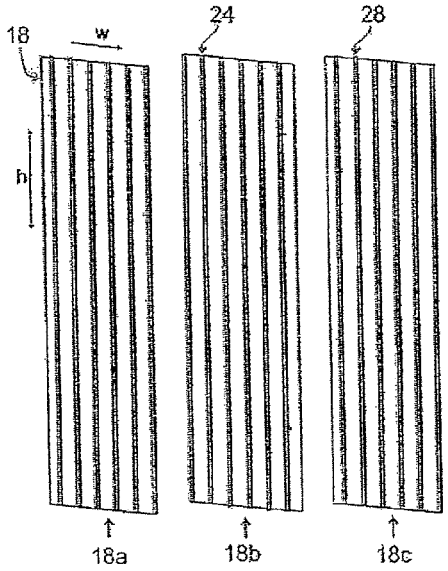
FIG. 2 is a perspective view showing three of the panels used to form the partition of FIG. 1.
Figure 3:
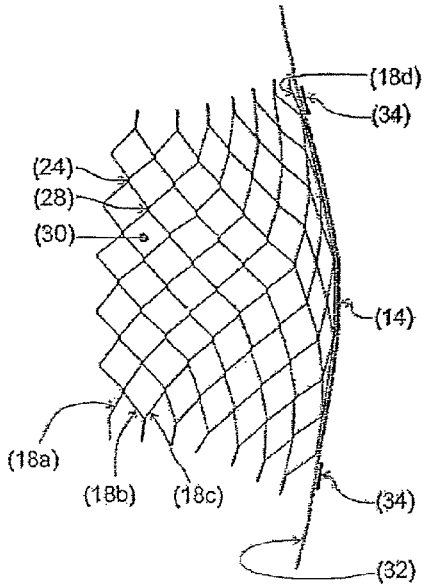
FIG. 3 is a view on the line of FIG. 1.

Referring therefore to FIG. 1, a partition 10 comprises a core 12 and a pair of supports 14, 16 at opposite ends of the core 12. As can best be seen from FIGS. 2 and 3, the core 12 is formed from a plurality of panels 18. The panels 18 each have a pair of oppositely-directed major faces 19, 20, and are formed from a flexible flaccid material. In the preferred embodiment, the material forming the panels 18 is standard white, flame retardant tissue paper, having a weight of approximately 13.5 lbs (500 sheets @ 24"×36"=13.5 lbs). Each panel has a major dimension or height h and a width w which may be adjusted to suit particular environments. Typically the height will be in the order of 1-2 metres but could range from 0.5-3 metres when used as a partition, or 0.1 metres to 0.5 metres when used as a seat. A seat height of 0.45 m has been found particularly beneficial. The width is typically in the order of 30 centimetres but could range from 10-100 centimetres. Adjacent panels 18 are inter-connected to one another at spaced intervals that alternate across the width of the face of the panel 18. As indicated in FIG. 2, the connection between panels 18*a* and 18*b* is through a series of parallel, laterally-spaced strips 24 on the face 19 of panel 18*b*. The strips 24 are defined by stripes of adhesive, which connects the panels 18*a*, 18*b* to one another, as shown in FIG. 3.

Similarly, the inter-connection between a panel 18*b* and 18*c* is through spaced parallel strips 28 on the face 19 of panel 18*c* which are offset from the strips 24. Each of the panels 18 is therefore alternately connected to the panel 18 on opposite sides so that, as shown in FIG. 3, upon extension of the panel in a horizontal direction, a cellular structure having voids 30 is formed within the core. The voids 30 extend vertically from top to bottom of the core 12 with the panels 18 providing a continuous transverse barrier. The lateral outer ends of each of the panels 18 are connected so as to form vertical pleats on the exterior faces of the core 12.

An end panel 18*d* of the core is connected to respective ones of the supports 14 and 16 over its entire width. The supports 14 and 16 are made from a self-supporting material, typically a non woven felt material, which has a degree of flexibility but also has sufficient rigidity to resist collapse of the core 12. In a typical application, the felt is a 1.95 nominal pounds per square yard felt having a thickness in the order of 3 millimetres, although other weights and thicknesses may be utilized as appropriate depending upon the overall dimensions of the partition 10. The supports 14 and 16 extend laterally beyond the core as indicated at 32 and are adhered to respective ones of the end panels 18*d*.

Fasteners in the form of a pair of loop and hook strips 34, such as that sold under the trade name "Velcro" are stitched to the felt supports 14 and 16, and extend vertically from one end to the other.

Figure 4:
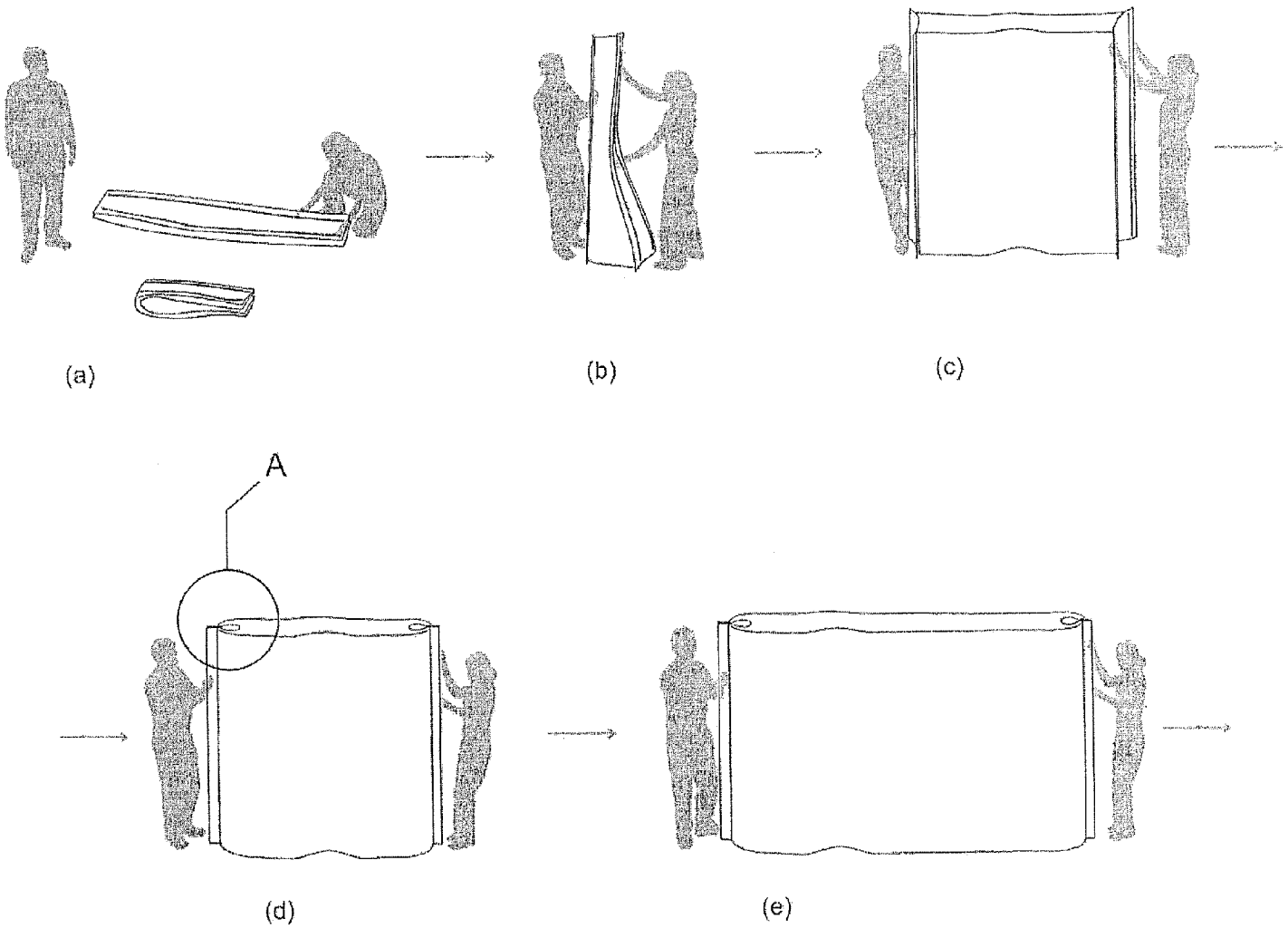
FIG. 4 is a series of views showing the sequential operations required to erect the panel of FIG. 1.

The core 12 is collapsible so that the major faces of adjacent panels 18 lay parallel to one another and in abutment. In this position, as shown in FIG. 4*a*, the partition 10 may be stored in a flat, collapsed position. When the partition 10 is required, it can be oriented vertically (FIG. 4*b*) and the opposite supports 14 and 16 used to manipulate the partition. The supports 14 and 16 are moved away from one another as shown in FIG. 4*c* to expand the core so that the cellular structure is opened within the core 12. The lateral extension of the supports 14, 16 beyond the core 12 provides marginal tabs that may be grasped to facilitate manipulation of the core without direct contact with the panels 18.

Once partially extended, the supports 14 and 16 may be folded along a vertical axis to provide enhanced rigidity at each end of the partition 12. This may be seen in more detail in FIG. 5 where it will be seen that the opposite edges of the supports 14 and 16 may be brought together so that the loop and hook strips 34 are brought into abutment. The loop and hook strips 34 engage one another and thus hold the support in a folded tubular configuration. This movement is accommodated by the flexible nature of the cellular structure which expands towards the lateral edges to accommodate the folding of the supports 14 and 16. With the supports 14 and 16 folded into a tubular support, extension of the core 12 continues as shown in view (e) of FIG. 4, until the desired overall length is reached.

With the partition 10 expanded, it has sufficient width to remain stable in a vertical position with the rigidity provided by the end supports 14 and 16. The material forming the panels 18 is preferably translucent so that a pleasing transmission of light through the panel may occur, while still providing a degree of privacy.

Figure 8:
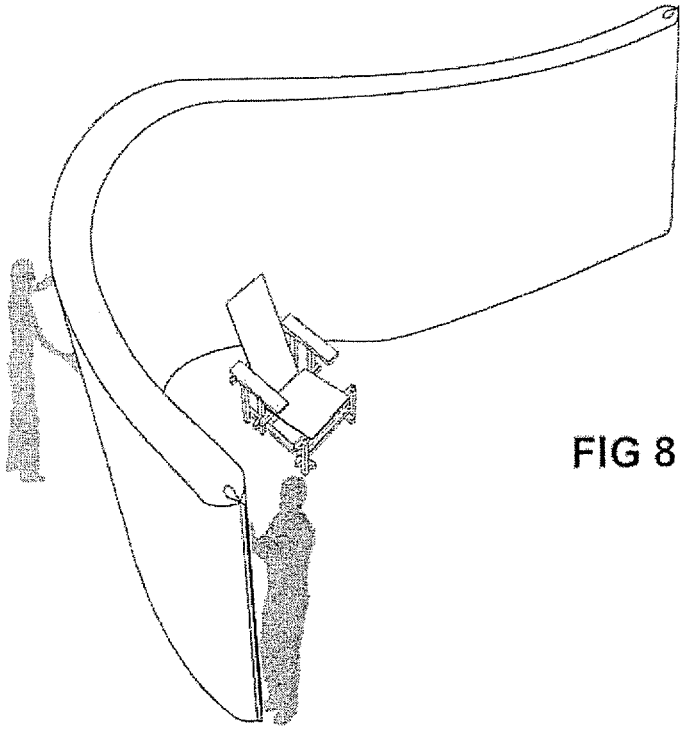
FIG. 8 is a top perspective view showing the arrangement of a panel within a living area.
Figure 9:
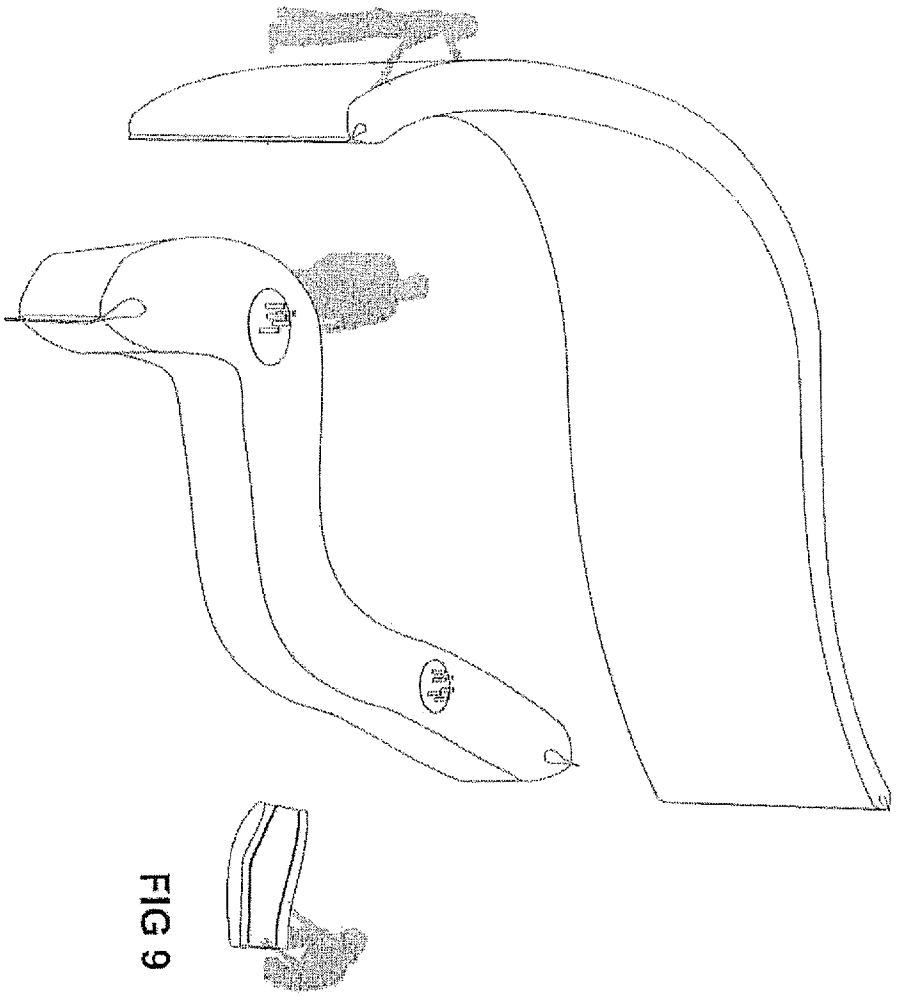
FIG. 9 is a top perspective view showing an alternative configuration of panel.

The extended partition as shown in FIG. 4*e* may be adjusted to different configurations as illustrated by the open curve shown in FIG. 1 and the wrapped curve shown in FIG. 8. The core 12 has a surprising degree of flexibility to accommodate different configurations and allow an appropriate shaped and sized partition to be installed in an otherwise open space. By varying the overall dimensions, additional functionality may be obtained. The extended partition shown in FIG. 4*e* may also be made with a lower height, for example 1 metre and a wider base, for example 0.5 metres so that the top surface of the partition may be used as an area to display objects. Such an arrangement is illustrated in FIG. 9. Where appropriate, the terminal portions of the voids 30 may be used as a pocket to support a container, such as a vase, or similar object. In this embodiment, the height would be between 0.5 and 1.5 metres.

Figure 6:
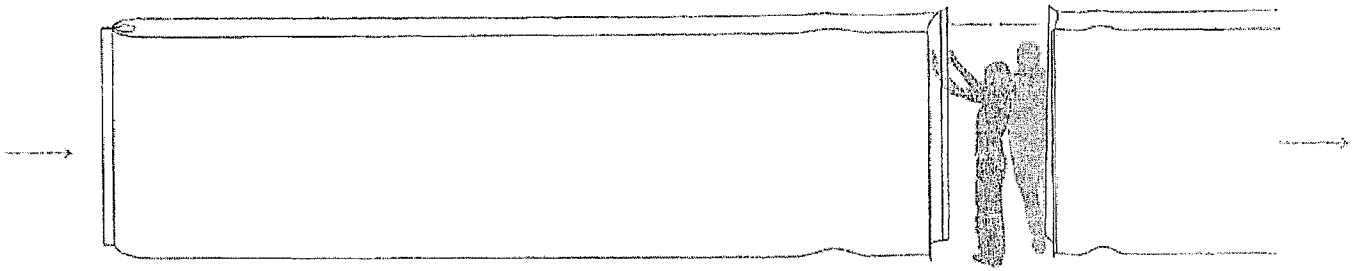
FIG. 6 is a view showing the sequential steps to join a pair of panels shown in FIG. 1 end-to-end.
Figure 6:
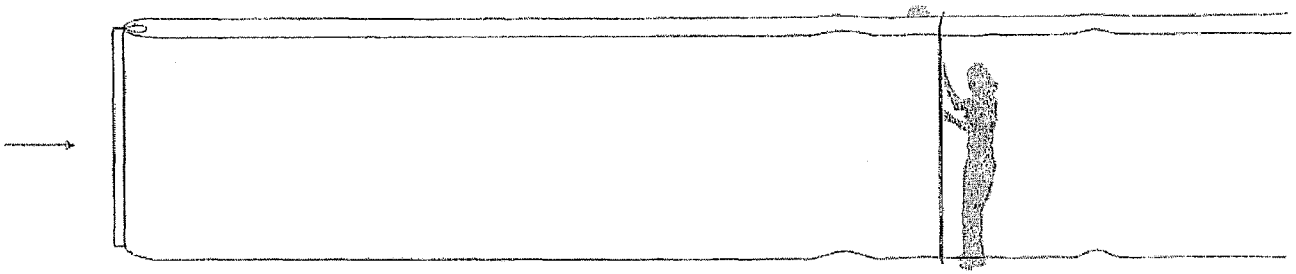
Figure 7:
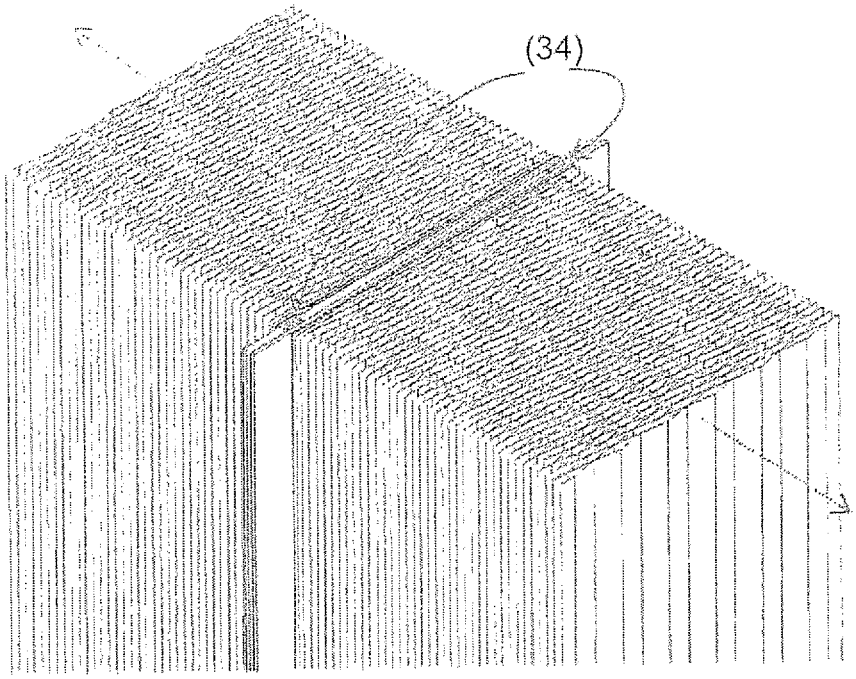
FIG. 7 is a detailed view of the inter-connection of the panels shown in FIG. 6.

The provision of the supports 14 and 16 also permits a pair of partitions 10 to be joined end-to-end as shown in FIG. 6. As may be seen from FIG. 6*a*, a pair of partitions 10 is erected and positioned with supports 14, 16 at opposite ends of each partition adjacent one another. The loop and hook strips 34 in adjacent supports 14, 16 are then brought into contact with one another as shown in FIG. 7 so that the partitions 10 are joined in seriatim. The additional thickness provided by the double support at the intersection enhances rigidity, with the supports 14, 16, at the free ends of the partition being folded upon themselves to provide stable support.

After use of the partition 10, it is simply necessary to reverse the procedure by moving the ends towards one another, unfolding the supports 14 and 16, and collapsing the core 12 to its minimum size. It may then be stored and used when subsequently required.

In the above embodiments, the core has been made from a light weight paper material, although it will be apparent that alternative materials may be used that fulfil the same functional requirements. For example, it is possible to utilize a heavier weight paper material, such as Kraft paper, or a non-woven textile material such as a plastic material known as Tyvek from DuPont which is both tear and water resistant. Alternatively, a paper laminated with a plastic film to provide a composite material may be used. With such a core material, the supports 14 may be made of a felt or may be made from a material similar to the core material but with increased thickness. The felt used in the support would be sufficiently flexible to allow folding to define the tubular support structure at each end with fasteners such as the loop and hook strips 34 incorporated on the support. In some applications, the inherent stiffness of the material used in the core is such as to provide sufficient rigidity to the core when the cellular structure is expanded for the core to be self supporting when expanded. Kraft paper or plastics material has provided sufficient rigidity for this purpose. In this case the supports may be provided to permit connectivity if multiple units are to be joined end to end.

Whilst a translucent material is preferred, it will be apparent that opaque or different coloured materials may also be utilized. The dimensions of the void 30 and the number of voids in the lateral direction may be adjusted to suit particular applications. It has been found in practise that a spacing between stripes 24, 28 in the order of 5-10 centimetres (when unexpanded) is appropriate, although spacing as low as 1 cm. may be used, and that the width of the stripes 24, 28 is between 1 and 10 millimetres. This arrangement provides a flexible structure with extensive elongation to provide maximum functionality.

Figure 10:
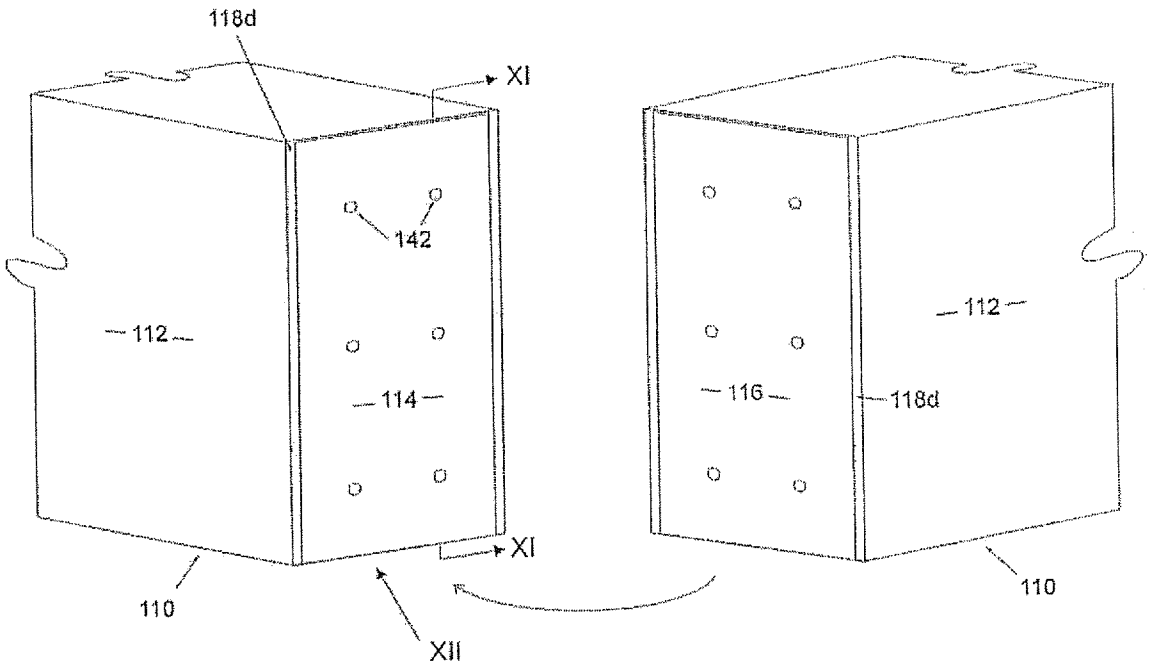
FIG. 10 is a schematic representation of an alternative embodiment of connection applied to a partition.
Figure 11:
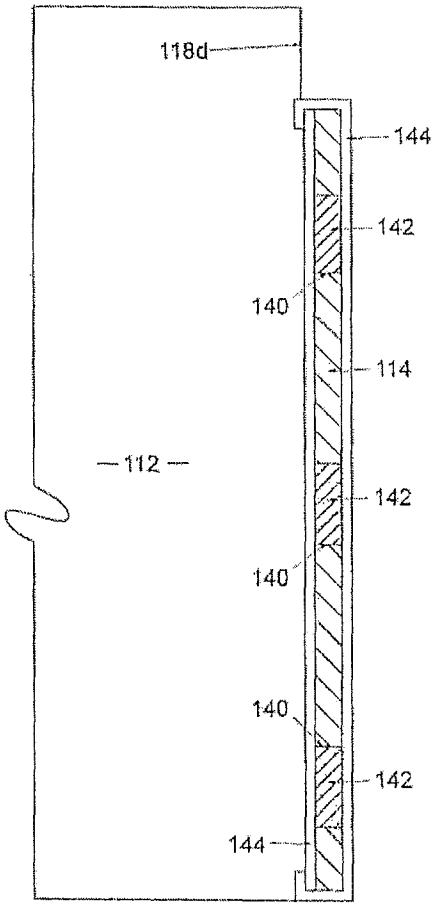
FIG. 11 is a view on the line XI-XI of FIG. 10.
Figure 12:
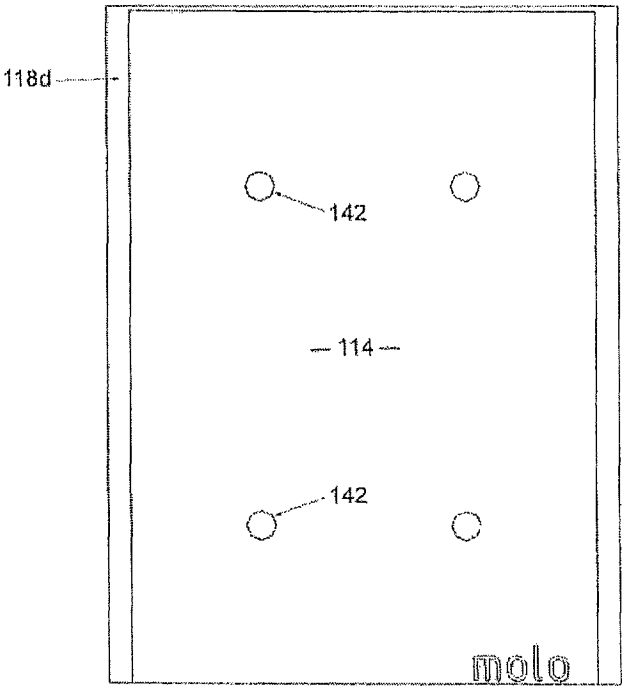
FIG. 12 is a view in the direction of arrow XII of FIG. 11.

An alternative form of connection for articles of flexible furniture is shown in FIG. 10-12, in which like reference numerals will be used to denote like components with a prefix 1 added for clarity. In the embodiment of FIG. 10, a pair of partitions 110 are arranged to be joined end-to-end in a manner similar to that shown in FIG. 6. The end panel 118*d* of the core 112 is secured to supports 114, 116. The supports 114, 116 are made from a self-supporting material, which in this embodiment are preferably made from a rigid material such as a millboard. The supports 114, 116 lay within the periphery of the end panel 118*d* so that the end panels 118*d* overlap by a margin in the order of 20 millimetres around the millboard.

Each of the supports 114, 116 has a series of holes 140, best seen in FIG. 11 formed through the millboard. The holes are arranged in a regular pattern, as will be described more fully below with respect to FIG. 13, and are arranged to receive rare earth magnets 142. The magnets 142 are typically in the order of 3 millimetres thick and 25 millimetres diameter. The magnets are a tight sliding fit in the holes 140 so as to be frictionally retained by the millboard. The millboard itself is chosen to be of the same thickness as the magnet 142 so that the face of the magnet 142 is flush with the surface of the millboard.

The magnets 142 are oriented such that a common polarity is present for all magnets on one face. Thus the magnets in the support 114 shown in FIG. 10 are oriented such that the north pole is exposed and those of the support 116 in the adjacent partition 110 are arranged such that a south pole is exposed. The exposed end face of the millboard is wrapped by a cover 144 of the same material as used to produce the core 112 for aesthetic purposes and to retain the magnets in situ. The cover 144 extends over the edges and each face of the millboard to provide self contained end supports 114, 116 to facilitate manufacture as well as enhance the aesthetics.

With the magnets in situ, the partitions 110 may be connected to one another by relying upon the magnetic attraction between the opposite poles of adjacent partition. The rare earth magnets 142 have sufficient force to retain the supports 114, 116 in abutment with one another. However the supports may be readily separated by sliding the partitions relative to one another or pulling them apart axially to release the magnets. The margin of the end panel 118*d* provides a flexible tab to permit manipulation of the core 112.

Figure 13:
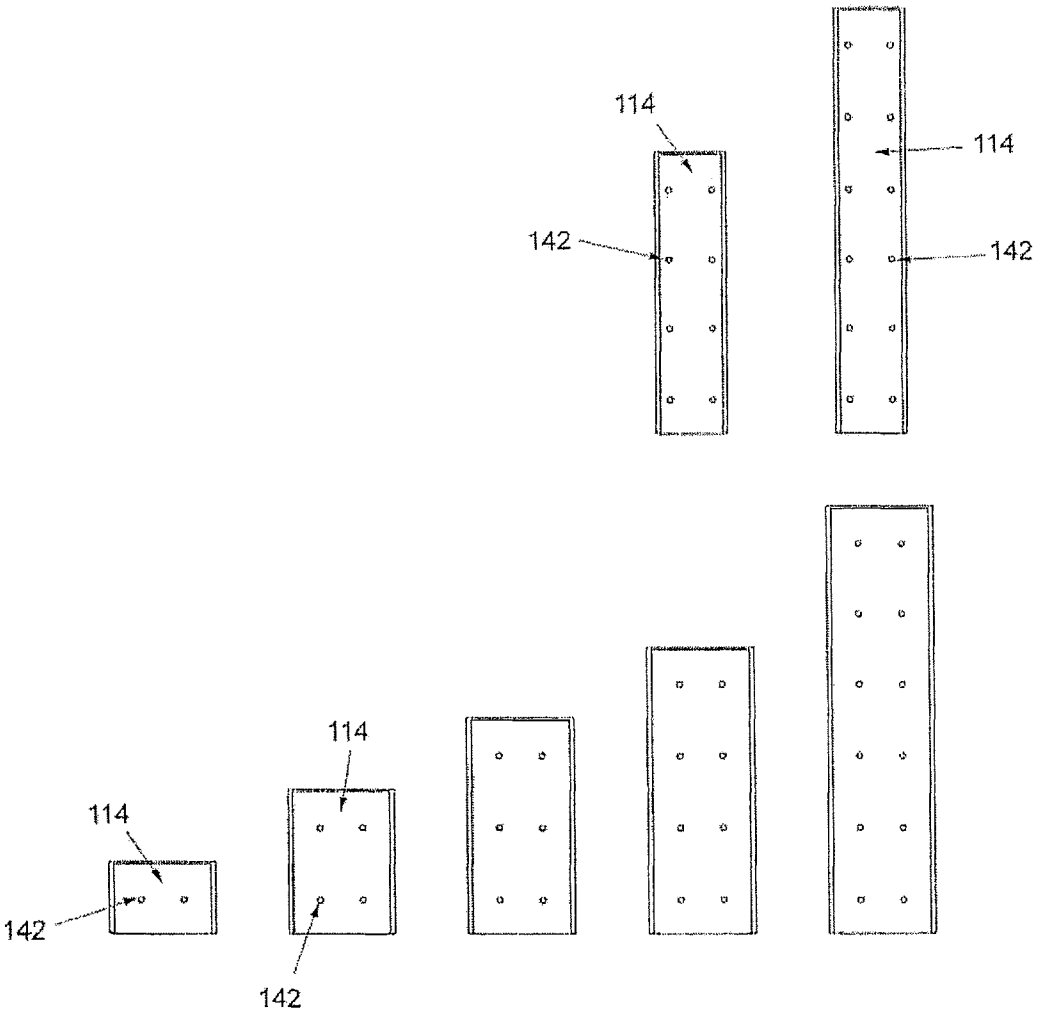
FIG. 13 is a schematic diagram showing the arrangement of the connection of FIG. 10 with different size partitions.

As can be seen in FIG. 13, the arrangement of magnets 142 on the support 114, 116 provides a grid that allows different size partitions to be connected in seriatim. The magnets 142 are arranged in two columns in rows uniformly spaced such that a relatively tall partition may be attached to a relatively small partition with the magnets 142 in alignment. The grid also allows partitions to be stacked on top of one another and connected in seriatim to a taller partition to form a continuous wall.

Figure 5:
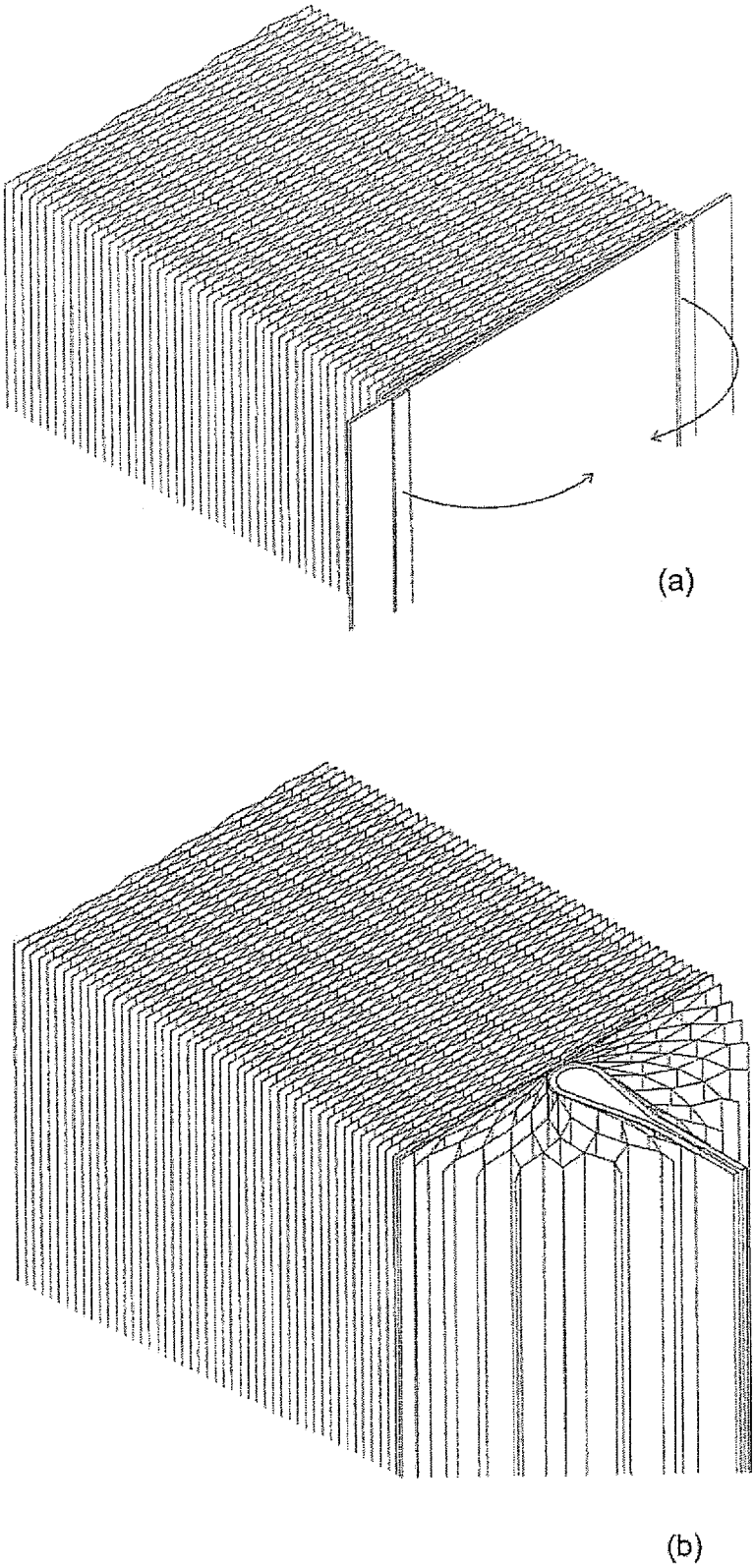
FIG. 5 is a detailed view of the portion shown in circle A in FIG. 4.

Whilst it is convenient that the supports 114, 116 are formed from rigid millboard to carry the magnets, it will also be apparent that a similar arrangement may be achieved using the self-supporting flexible supports 114, 116 such as the felt shown in the embodiments of FIGS. 1 through 9. The end panel 118*d* and the covering panel 144 secures the magnets 142 within the flexible support 114, 116 so as to be retained within the hole 140. This arrangement would also allow the end panels to be folded as shown in FIG. 5 provided that the orientation of the magnets is such that one column has a north polarity and the other column has a south polarity. A complimentary arrangement on the support of an adjacent partition will still permit the partitions to be joined to one another in seriatim as well as folded.

Figure 14:
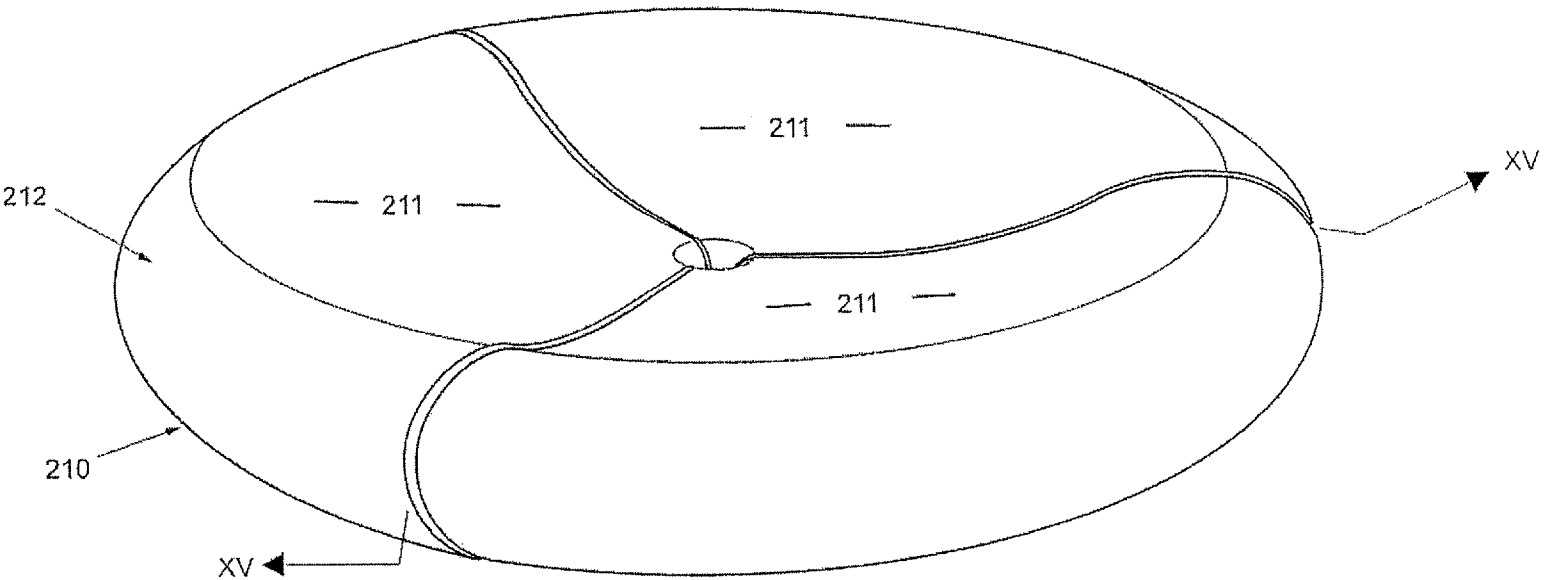
FIG. 14 is a top perspective view of a seat arrangement incorporating the connection of FIG. 10.
Figure 15:
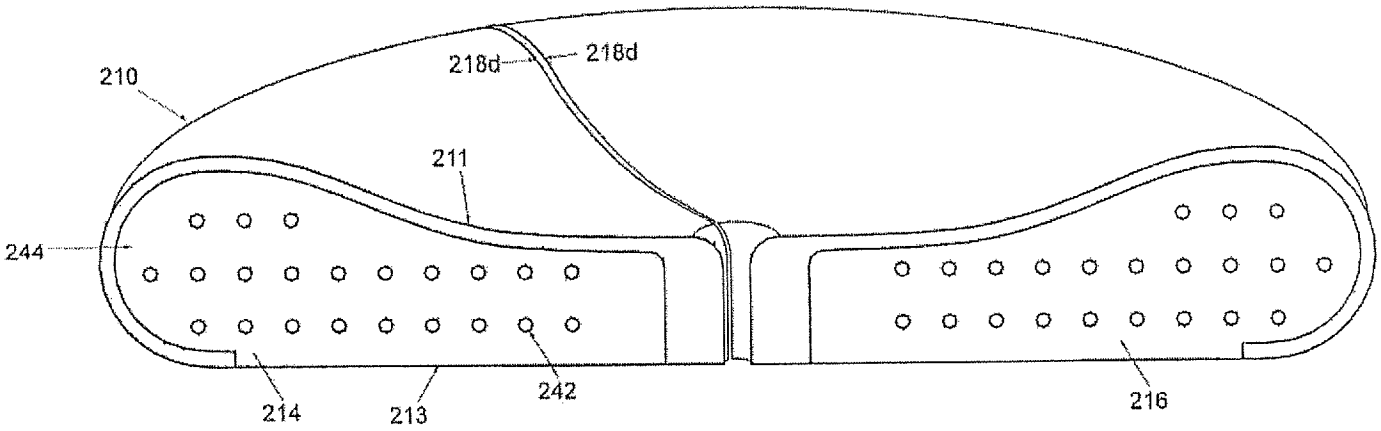
FIG. 15 is a view on the line XV-XV of FIG. 14.

The embodiments are described above in the context of a partition. However, the ability to dimensionally resize the core 12 provides for its use in alternative articles of flexible furniture, such as those shown in FIGS. 14 through 17. In the embodiment of FIG. 14, a circular seat 210 is provided having a concave upper surface 211. As seen in FIG. 15, the lower surface 213 of the core 212 is planar to sit against the floor and the upper and side surfaces smoothly curved. The opposite end faces 218*d* of the core are secured to supports 214, 216 that carry a series of magnets 242. The magnets are wrapped by a cover 244 of the material used to form the core to provide a pleasing aesthetic as well as secure the magnets 242 within the supports 214, 216. The seat 210 may be stored in a collapsed flat position and when needed expanded into a circular array with the supports 214, 216 in abutment. The magnets 242 secure the supports 214, 216 to one another and hold the core 212 in the circular configuration presenting an upper concave surface 211. For storage, the supports are separated and the core collapsed to a flat configuration.

As shown in FIG. 14, the seat 210 is formed from three cores 212 joined end to end to make a torous. It will be apparent that the overall diameter of the seat 210 may be increased by expanding the inner diameter of the torous and thereby further expanding the cores 212. Alternatively, a single core 212 may be used with the supports 214, 216 connected to one another, provided there are sufficient laminated panels to permit extension of the core over the required circumference. In this case, the diameter will be similar to that shown in FIG. 14.

A simple seat may be provided in a similar manner by having an expanded core 212 with a planar upper surface 211, arranged either in a cylindrical form with supports 214, 216 in abutment, or in the form of a bench with said supports not in abutment. In each case, multiple units may be joined end to end to increase the diameter of the cylindrical seat, or the length of the bench, which can be arranged linearly, or in an undulating manner, and which can act as a form of partition, as shown in FIGS. 1 to 9, and may be stacked one on top of the other to increase the overall height.

When used in a seating embodiment, the dimensions of the cellular structure and the stiffness of the material used is adjusted to provide an increased structural rigidity and increased weight bearing capacity. Kraft paper has been found to have the requisite properties and it has been found preferable to reduce the spacing between the glue stripes to 2.5 cm so that the maximum dimension of each void 30 in a collapsed state is 5 cm.

Figure 16:
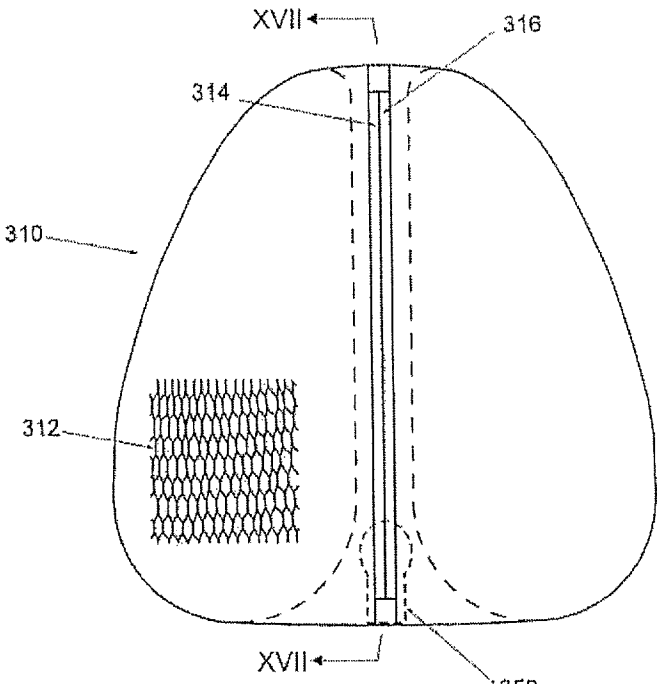
FIG. 16 is a front elevation of a light incorporating a connection similar to FIG. 10.
Figure 17:
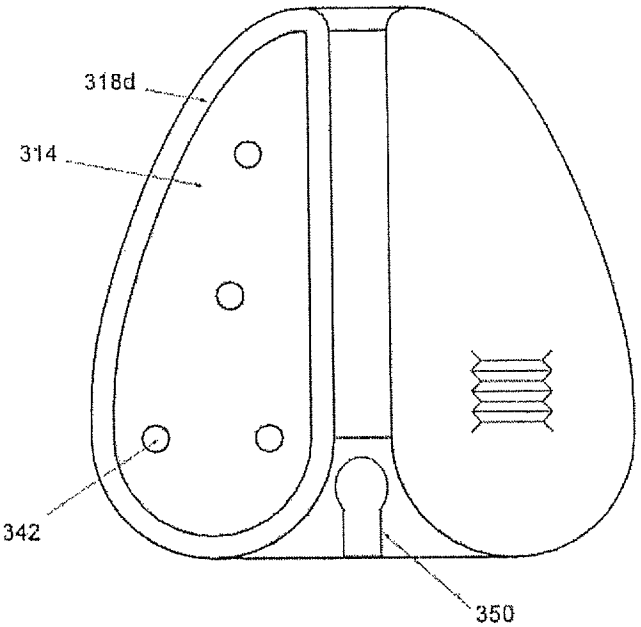
FIG. 17 is a section on the line XVII-XVII of FIG. 16.

A similar arrangement of flexible furniture is used with respect to a light as shown in FIGS. 16 and 17 in which like reference numerals will be used to denote like components with a prefix 3 for clarity. In the embodiments of FIGS. 16 and 17, a light 310 is formed with a core 312 with end panels 318*d* secured to respective supports 314, 316. In this arrangement the axis of the voids is radial although an axial orientation may be used if preferred. The supports, as shown in FIG. 17, carry an array of magnets 342 so that the supports may be joined to one another as described above. A bulb 350 is located within the centre chimney formed by the fanning of the core 312. The bulb 350 illuminates the core 312 to provide a pleasing effect and the heat may escape through the central aperture provided by the core. Naturally the core is formed from a fire-resistant material, or the light source produces only a small amount of heat. The light 310 may be collapsed and stored in a flat configuration and deployed as required in different locations.

It will be apparent from the various embodiments described above that the provision of the cellular structure to form the core and the releasable fastenings provided at the end panels allow for a variety of configurations to be provided. The provision of the magnets or other fasteners in a pre-defined grid permits different components to be joined to one another to increase a variety of configurations that may be utilized. As indicated above, the dimensions of the core may be adjusted to suit particular requirements, ranging from a single row of voids to provide a thin or narrow partition, to a relatively wide cellular structure with multiple rows of voids to provide seating or table like surfaces.

The configuration of the core 312 as shown in FIGS. 14 to 17 facilitates production of articles of different sizes from the same blank of core 312.

Figure 18:
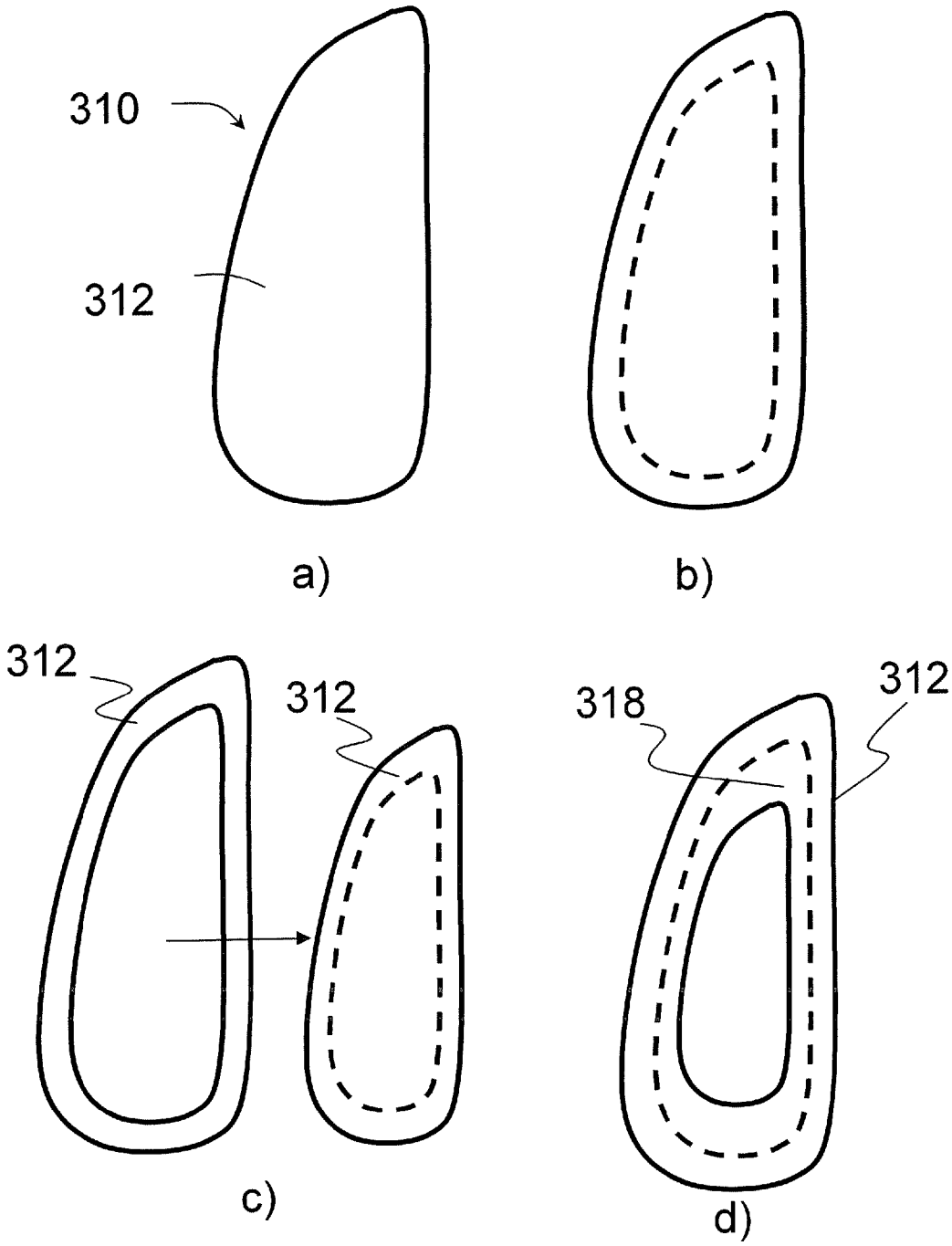
FIG. 18 is a schematic representation of a method of manufacturing a light similar to that of FIGS. 16 and 17.

As shown in FIG. 18*a*, the core 312 is die cut to the overall shape of the half section of the light 310 or seat 210.

The centre section of the core may then be removed, as shown in dashed line of FIG. 18*b* to provide a pair of blanks as shown in FIG. 18*c*. Each is used as a blank, with the centre, a smaller, but similar, blank for another light 310 or seat 210.

The supports 314, 316, are secured to end panels 318 and overlap on the radially inner edge to allow manipulation of the core 312 without unduly restricting the inner void defined when the core is deployed in to a circular arrangement. This overlap provides a convenient handle to allow the core to be pulled in to a circular configuration which is particularly beneficial when used on the seat 210.

Figure 19:
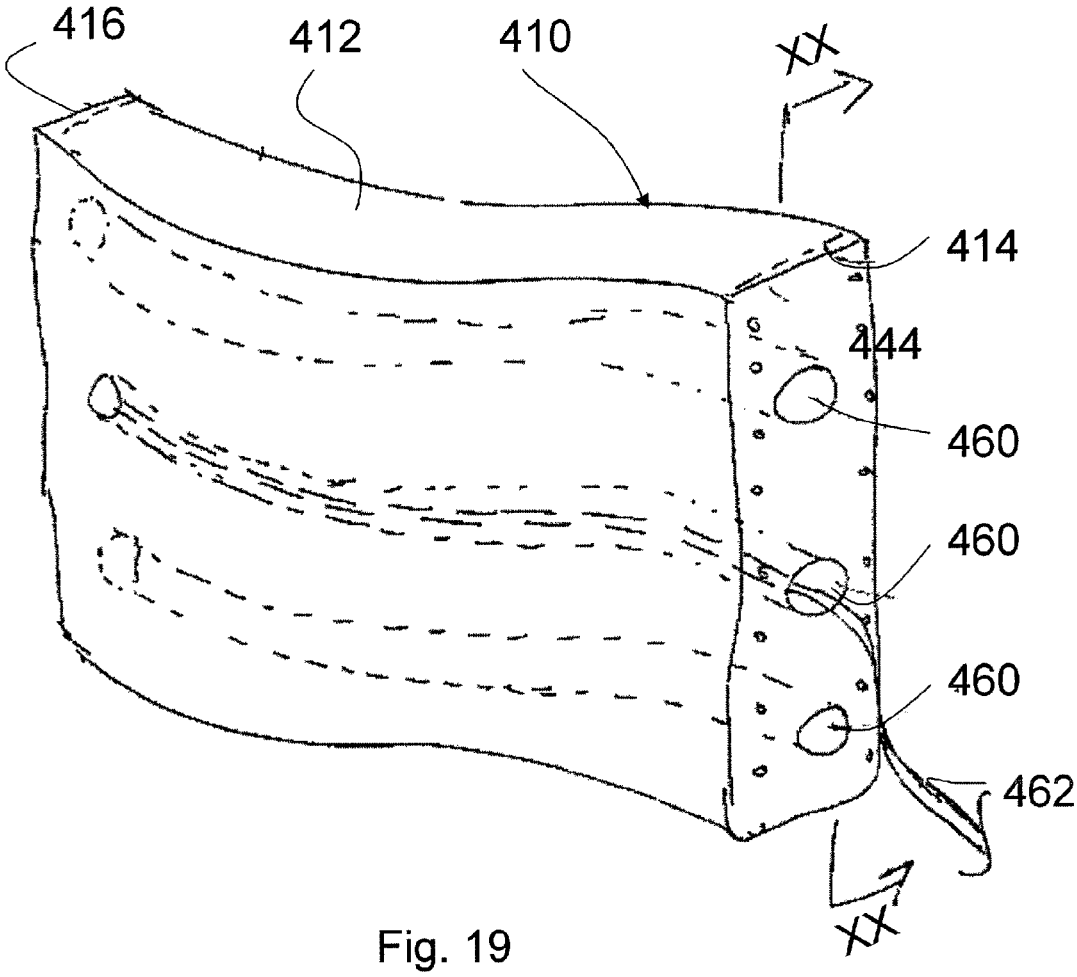
FIG. 19 is a prospective view of a further embodiment of a partition.
Figure 20:
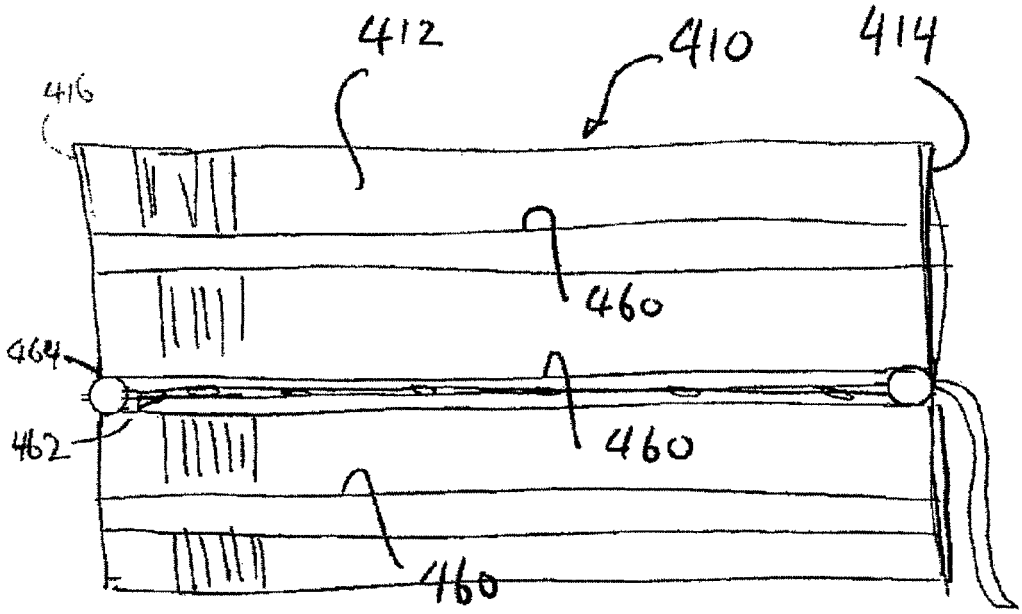
FIG. 20 is a view on the line XX-XX of FIG. 19.
Figure 21:
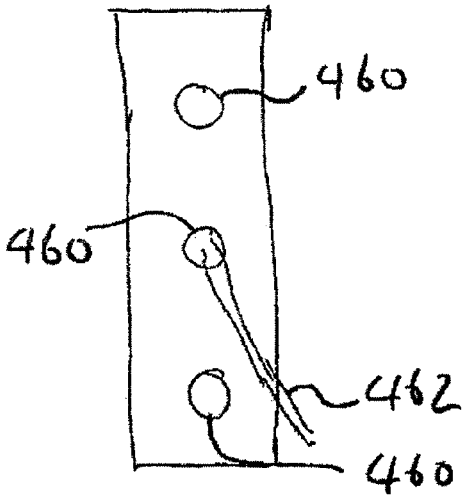
FIG. 21 is a end view of the partition shown in FIG. 19.
Figure 22:
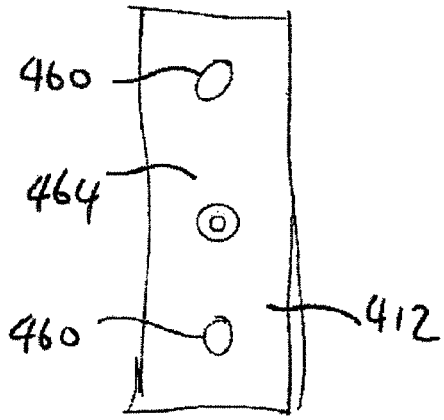
FIG. 22 is a view similar to FIG. 21 of the opposite end of the partition of FIG. 19.
Figure 23:
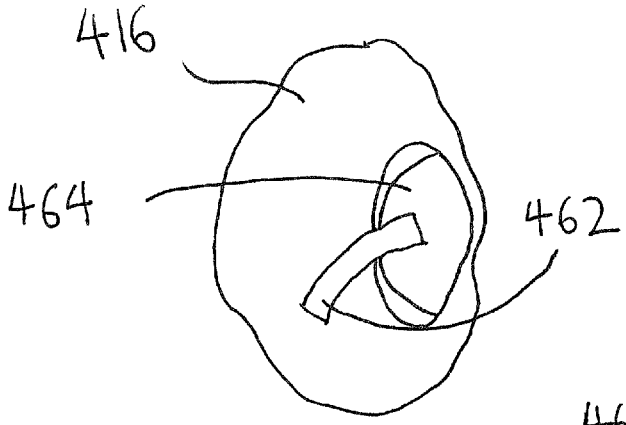
FIG. 23 is an enlarged detailed view of a portion of the end wall of the partition shown in FIG. 22.

A further embodiment of partition is shown in FIGS. 19 through 45 in which similar reference numbers will be used to identify like components for the prefix 4 for clarity. The embodiment of partition shown in FIGS. 19 through 45 may be used in a number of ways to enhance the aesthetic appeal of the partition and to increase its functionality Referring therefore to FIG. 19, partition 410 has a core 412 formed from panels of translucent material as particularized above. End supports 416 and 418 are provided in opposite ends of the core 412 and are covered by material 444 for aesthetic purposes.

A series of longitudinal passages 460 extend through the end panels 414, 416 and the core 412 so as to intersect the cells 430 transverse to their longitudinal axis. Each of the passages 460 is circular in cross section and is located on the center line of the core 412. The number of passages 460 may vary according to different applications but in the embodiment shown in FIG. 19, three passages 460 are formed through the core 412 at uniformly spaced intervals.

The passages 460 may be conveniently formed with the core 412 in a collapsed condition by using a paper drill bit or similar device, or die cut. Typically a diameter of 2 inches is appropriate for the passage 460.

The passages 460 may be used in a number of different ways. As shown in FIGS. 19 to 29, an LED light ribbon 462 is inserted into one or more of the passages 460 so as to extend through the core 412 to the end support 416. The LED ribbon 462 is a commercially available system such as that available from Alder under the tradename FlexLight Bars. The LED lights are distributed in uniform fashion along the length of the ribbon 462 and are supplied with power from a transformer unit incorporated into an electrical power supply in a conventional manner. A dimmer control may also be included to vary the intensity of the lights As can best be seen in FIGS. 20 and 23, one end of the ribbon 462 is secured relative to the end panel 416 by a foam ball, 464. The ball 464 is secured to the ribbon 462 after it has been inserted through the passage 460 and prevents the ribbon from being withdrawn. The ball 464 is deformable so as to be a snug fit in the passage 460 and so bears against the walls of the passage 460 to secure the ribbon 462.

Figure 24:
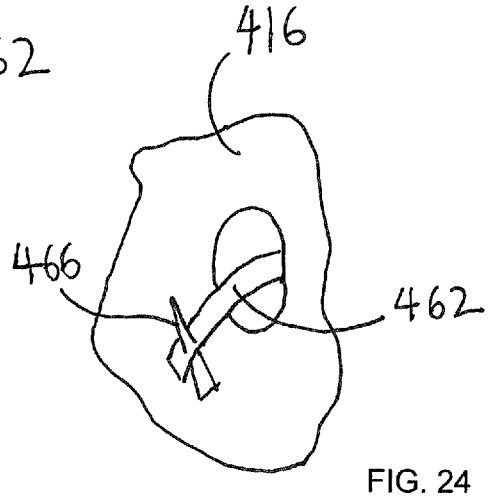
FIG. 24 is an alternative embodiment of the arrangement shown in FIG. 23.
Figure 25:
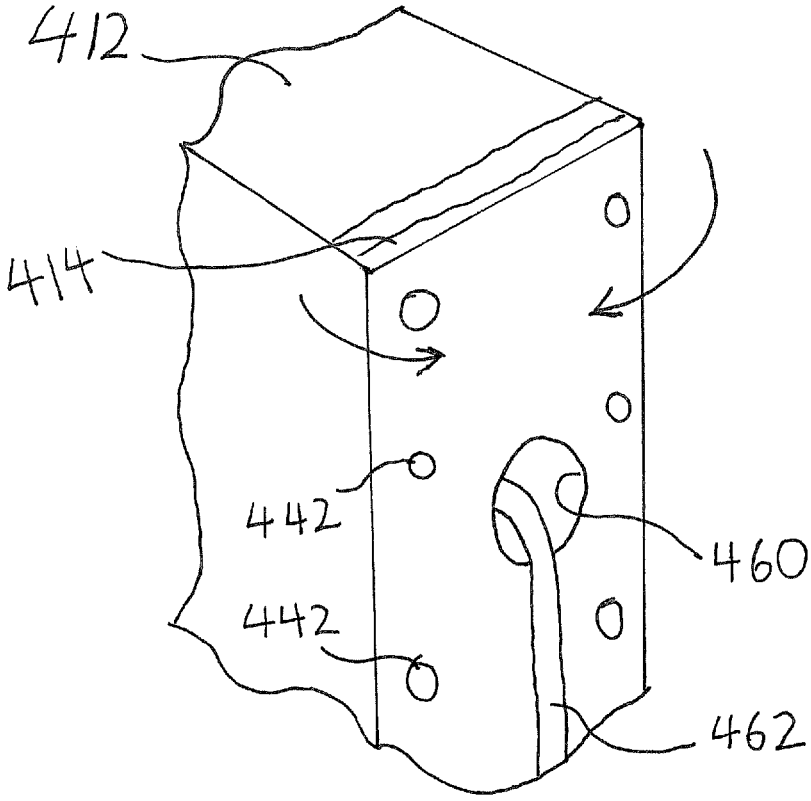
FIG. 25 is an enlarged view of the end of the partition shown in FIG. 21.
Figure 26:
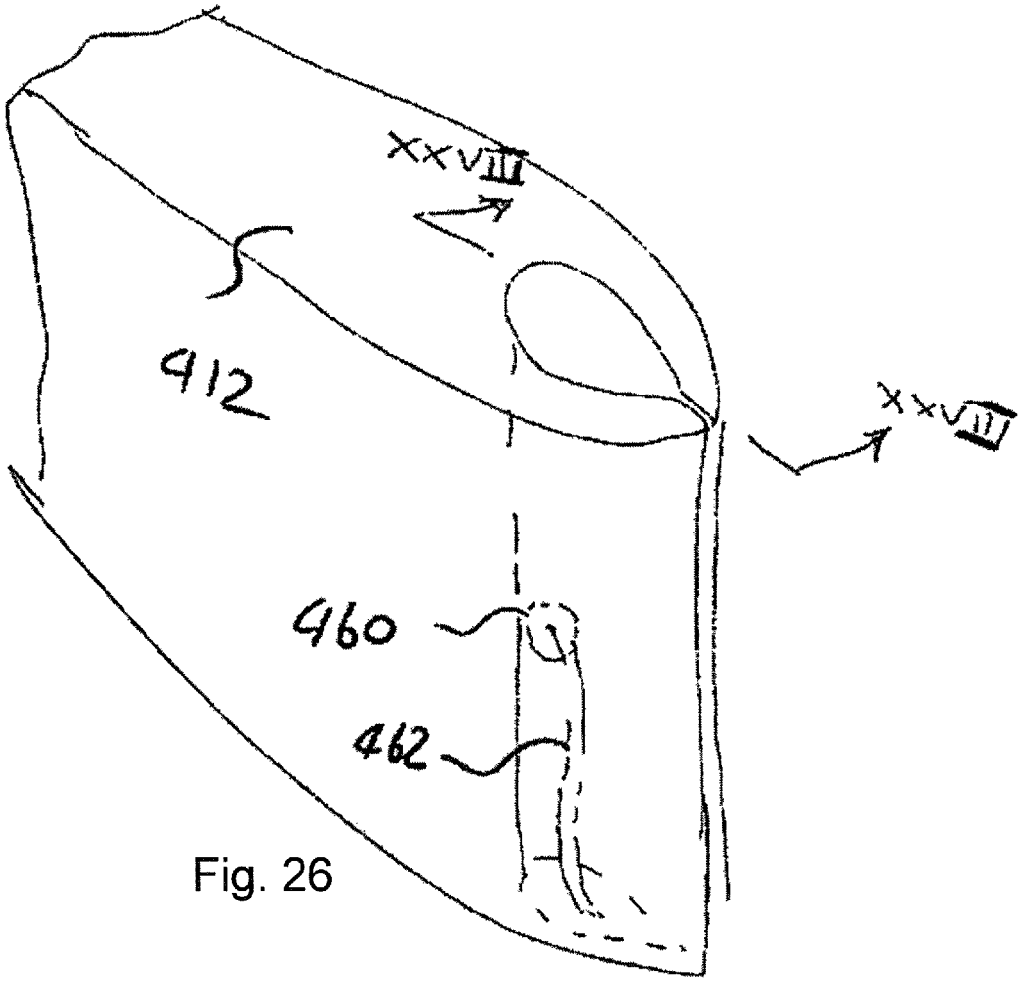
FIG. 26 is a view similar to FIG. 25 with the end wall of the partition closed.
Figure 27:
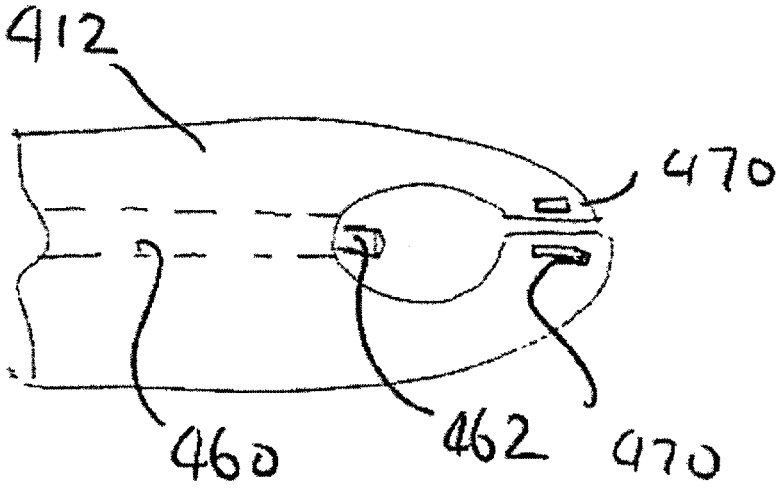
FIG. 27 is a plan view of FIG. 26.
Figure 28:
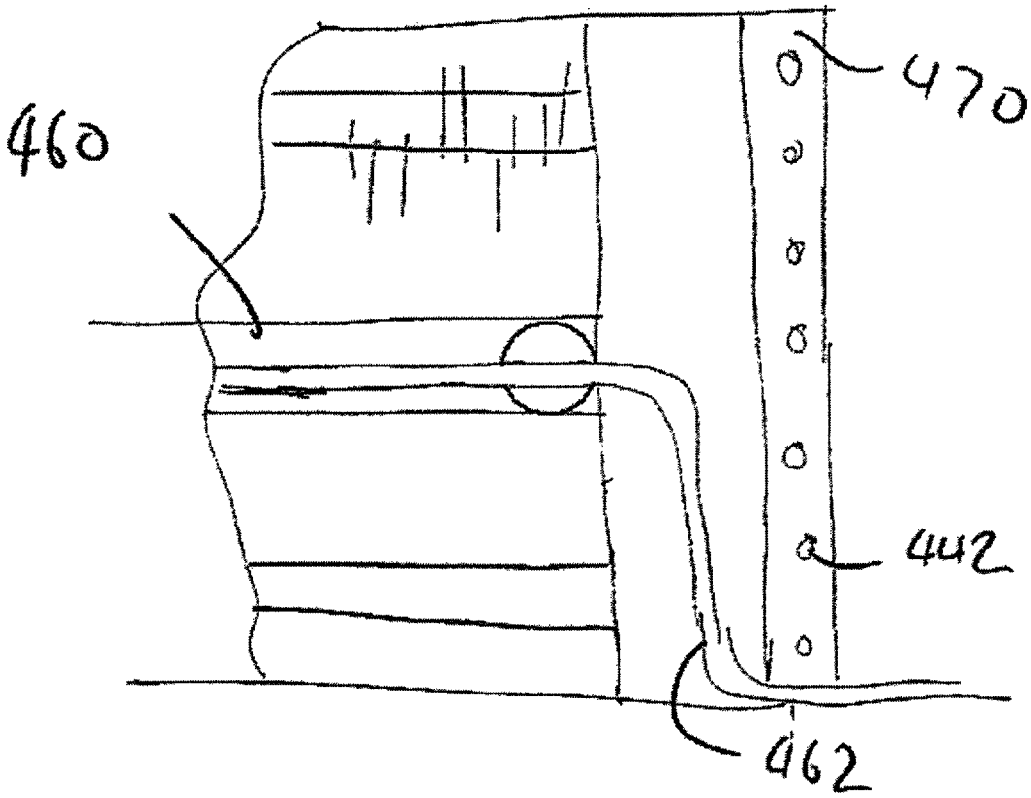
FIG. 28 is a section on the line XXVIII-XXVIII of FIG. 26.
Figure 29:
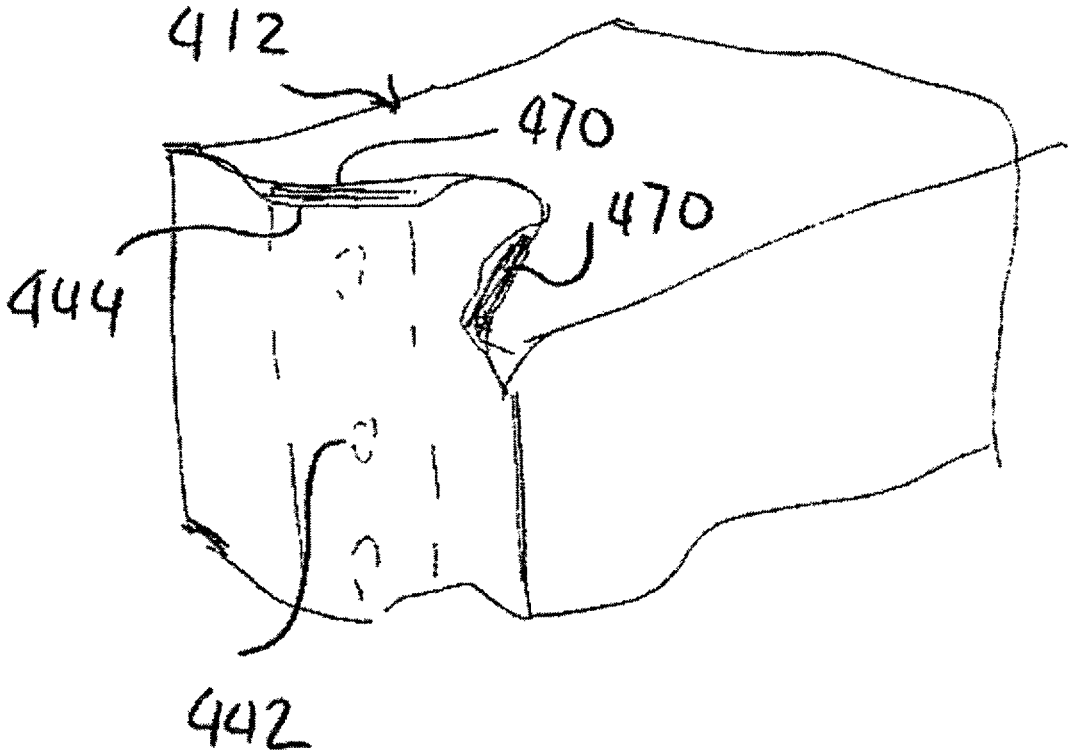
FIG. 29 is an enlarged view showing a portion of the end wall of FIG. 26.

As shown in FIG. 24, the ribbon 462 may also be secured by a bar 466 that passes through the ribbon but inhibits its removal through the passage 462.

As shown in FIGS. 25 through 28, the ribbon 462 may conveniently be concealed by the end panel 414 with the partition installed. The end panel 414 may be folded upon itself, as described above with respect to FIG. 5 to define a vertical panel in which the ribbon 46 can be concealed.

The end panels 414 and 416 carry magnets 442 in a manner similar to that described with respect to FIG. 10. The magnets 442 are mounted on plastic strips 470 secured to the end panels 414, 416 and covered by the covering 444. The magnets 442 are arranged in uniform spacing down each strip and the polarity of the magnets alternated both vertically along the strip and transversely between the two strips. In this manner, folding of the panels 414, 416 brings magnets of opposite polarity in to contact to secure the end panels in a folded condition and at the same time provides for inversion of successive partitions so that a magnetic connection between adjacent end panels will be obtained, regardless of the orientation of the panel.

In use, the ribbons 462 are inserted into the passages 460 and the ribbons secured by the end fastening in the form of a ball 464 or bar 466. This is most conveniently accomplished with the core 412 in the collapsed condition. As the partition 410 is expanded to the required length, the ribbon 462 slides within the passage way 460 so that the LED ribbon is uniformly distributed along the extended length of the core 412. The end panels 414, 416 are then folded on themselves with the ribbon 462 enclosed within the cavity. The relative sizing between the ribbons and the passage 460 ensures the ribbon can slide easily along the passage as the partition is expanded without binding or tearing the core 412.

When energized, the light from the LED is diffused through the core 412 giving a glowing appearance to the core 412. The intensity of the light may be adjusted by using more than one ribbon in the core 412 or increasing the number of lights for a given length of core. Controls including a dimmer switch may also be used to vary the intensity and may incorporate additional features such as motion sensors that allow the LED's to be switched successively as a person walks past the partition. Different coloured ribbons 462 may also be utilized to vary the visual effect.

The construction of the core 412 and the nature of the material making up the core effectively provides a relatively uniform diffusion of the light through the core, giving a soft glowing effect without high intensity point sources. The LED lights are relatively low heat output and so may be safely incorporated within the core 412 without risk of fire.

In order to store the partition 410, the end walls 414, 416 are brought together to collapse the core 412. As the core 412 is collapsed, the ribbon 462 slides out of the passage 460 so as not to hinder the collapse of the core 412. The ribbon 462 may either remain fixed within the passage 460 or, if preferred, may be detached and removed from the passage 460 for storage. The placement of the ribbon 462 within the passage 460 allows adjustment of the overall length of the partition 410 with the ribbon 462 conveniently sliding within the passage 460 during extension or collapse of the partition. As such the ribbon 462 does not inhibit the flexibility or placement of the partition in use.

Figure 30:
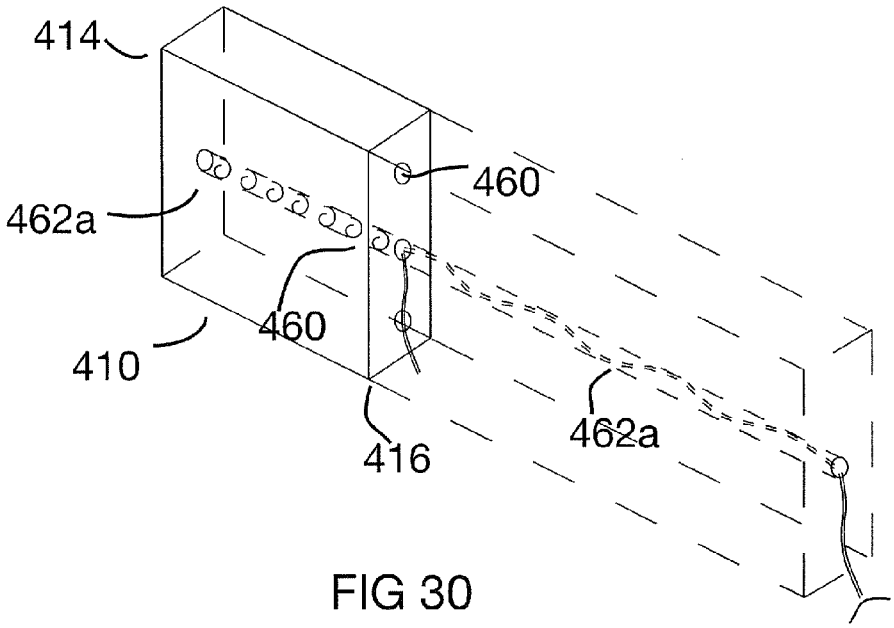
FIG. 30 is a perspective view of an alternative embodiment of partition.

The ribbon 462 may alternatively be formed with a resilient spiral portion, as indicated at 462*a* in FIG. 30, so as to be extendible and retractable with the partition 410. The spiral ribbon 462*a* has LED lights at spaced intervals along its length and is inserted into the passage 460 with the partition 410 in a collapsed state. The ribbon 462*a* is secured at one end to one of the end panels 414, 416 and the other end panel is secured to the opposite end of the spiral portion 462*a*. As the end panels 414, 416 are moved apart, the spiral portion 462*a* extends whilst retaining a substantively uniform distribution of the LED lights. The spiral portion is designed so as to be extendable to the maximum length of the partition 410 so that the LED lights accommodate the variations in the partition 410 whilst being retained within the partition.

Figure 31:
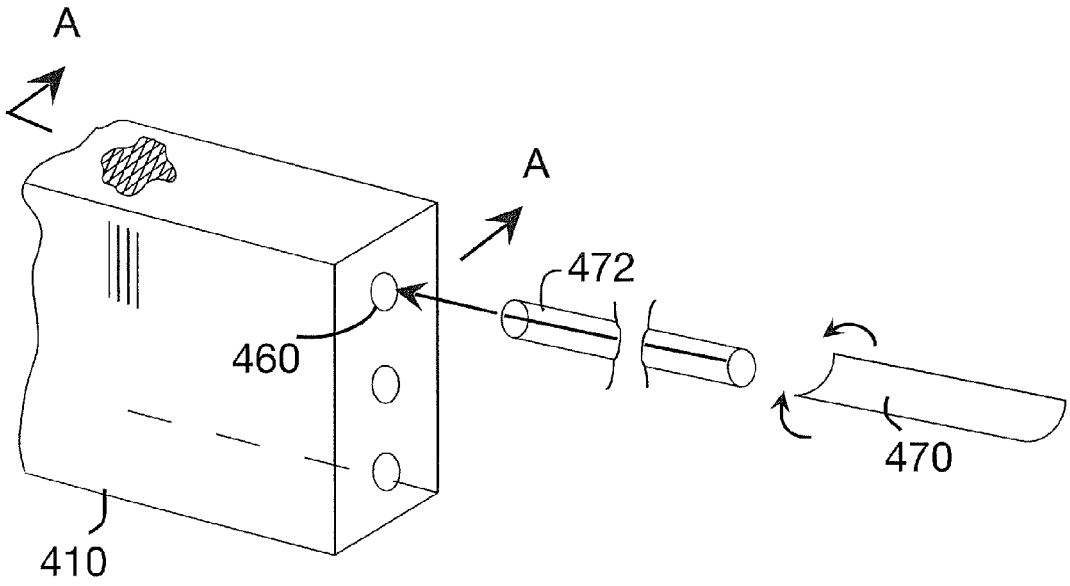
FIG. 31 is a view similar to FIG. 30 showing the assembly of the components of the partition of FIG. 30.
Figure 32:
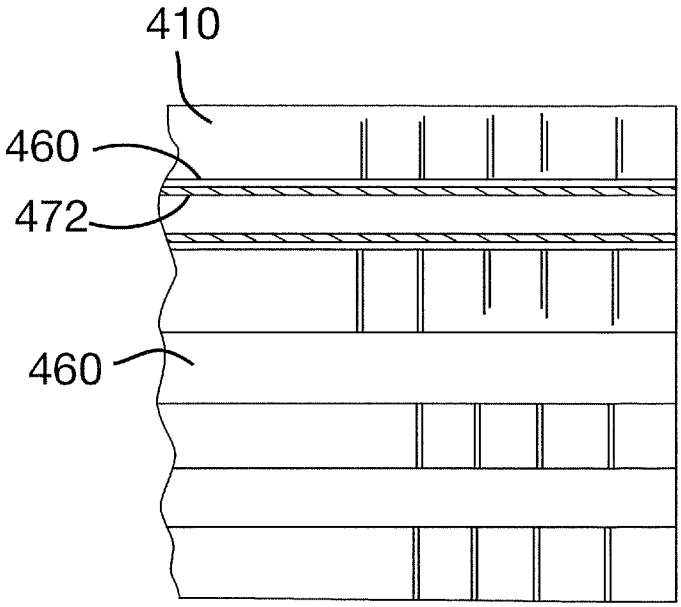
FIG. 32 is a view on the line A/A of FIG. 31 when assembled.
Figure 33:
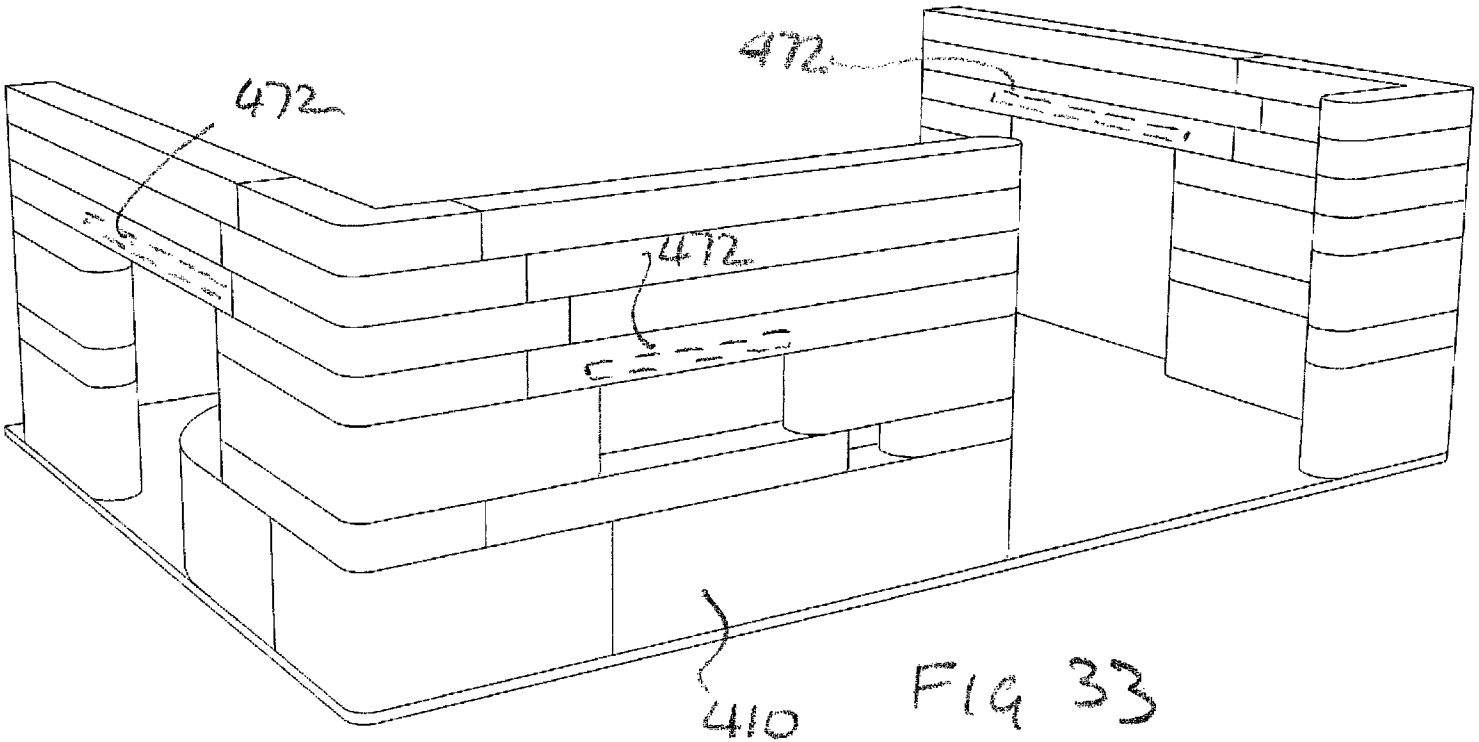
FIG. 33 is a perspective view of a building using partitions as shown in FIG. 31.

The passages 460 may also be used to provide internal stabilization to the partitions 410 without adversely impacting upon the aesthetic appeal of the partition. In FIG. 31, a flexible plastics sheet 470 such as mylar is rolled into a tubular insert 472 having an initial diameter slightly less than that of the passage 460. The tubular insert is inserted into the passage 460 to extend over the required length of the partition. As shown, the insert 472 extends over the whole length of the partition 410, but it can extend only along selected portions of the partition to provide reinforcement. The plastics material is selected to provide a degree of rigidity in bending so that the insertion of the tube 472 into the passage 460 increases the bending resistance of the partition. This permits the partition 410 to be utilized as a lintel as illustrated in FIG. 32. The plastics material is selected to be a length corresponding to the length of the partition when in use and may be inserted as the partition is expanded to that length. Once inserted the partition 410 is self supporting and may bridge gaps provided in a wall of partitions 410 as shown in FIG. 33. Materials other than mylar may of course be used and in general any flexible material that provides a sufficient degree of rigidity in bending when rolled in to a tube to increase the bending stiffness of the partition.

It is preferred that the material 470 is translucent so as not to be visible within the interior of the partition when in use. The formation of the material 470 into the tube 472 also permits the light ribbon 462 to be inserted down the tube and still provide the illuminating effect referred to above with respect to FIGS. 19 to 29. Of course tubes 472 may be inserted in to each of the passages 460 if desired, but in practice it is found that a single tube provides sufficient strength. The stabilization of the partition 410 by the tube 472 permits the use of the partition in different environments.

Figure 34:
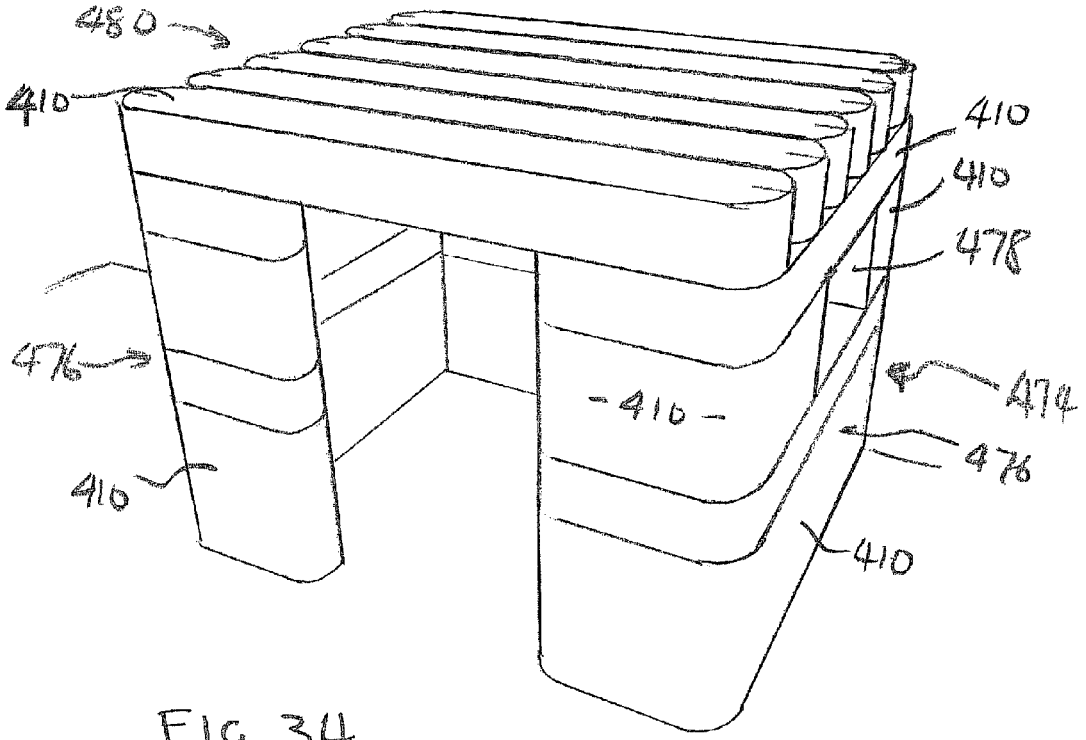
FIG. 34 is a perspective view of a further building utilizing the partitions as shown in FIG. 31.

As indicated in FIG. 34, the partitions 410 may be used to form a cubicle or room, generally indicated at 474, such as may be required as a temporary structure at a trade show or to provide a degree of privacy within an open area. The cubicle 474 has walls 476 formed from stacked partitions 410. An aperture 478 is provided on one of the walls 476 by spacing apart the ends of the partitions 410. The aperture 478 is bridged by a partition 410 containing a tube 472 so that the partition 410 does not sag over the aperture 478.

A roof structure 480 is formed by individual partitions 410 reinforced with a tube 472 that spans opposite walls 476. As can be seen in FIG. 34, the end panels of the partitions 410 used to form the roof structure 480 are folded together to provide a curved end and to hide the passage 460 from view.

Figure 35:
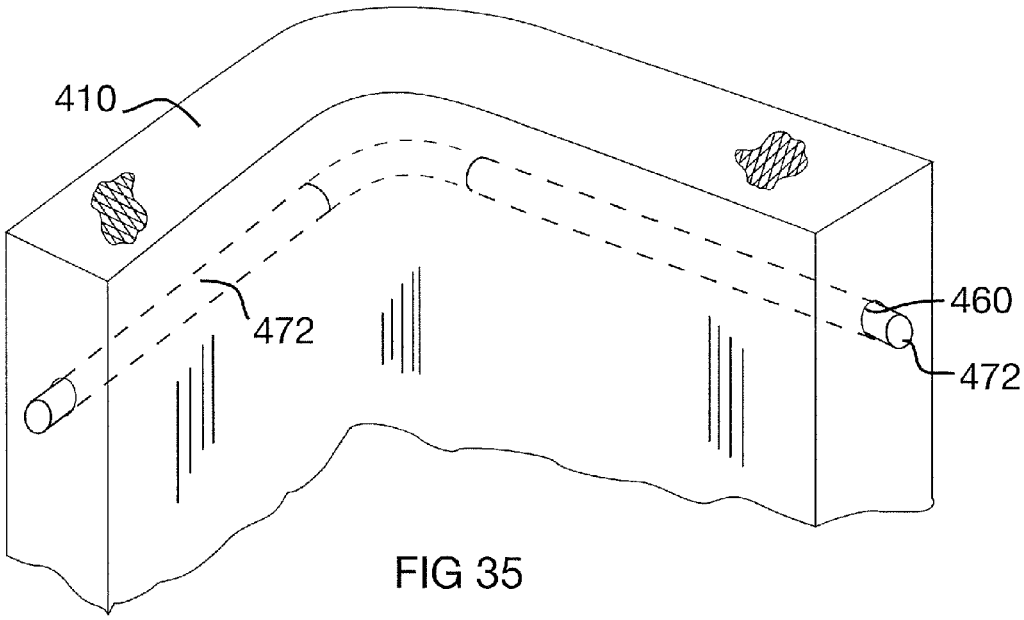
FIG. 35 is a schematic representation of an alternative embodiment to the partition shown in FIG. 31.

As described above with respect to FIGS. 31 to 34, the tubes 472 extend the full length of the partition 410. This of course inhibits flexure of the partition 410 along its length. The tubes 472 may extend over only part of the length to provide local reinforcement. Where such flexure is required, for example at a corner or to provide an abrupt change in the direction of the wall, the tubes 472 may be truncated and extend only partially along the length of the passage 460. This permits, as shown in FIG. 35, a spacing between the tubes 472 allowing the partition 410 to be bent in that zone. Obviously more than one gap may be provided between the tubes 472 where more complex shapes are required. Moreover, it will be appreciated that the extendibility of the partition allows the individual lengths of tube 470 to be inserted progressively at selected locations along the partition as it is assembled.

Figure 36:
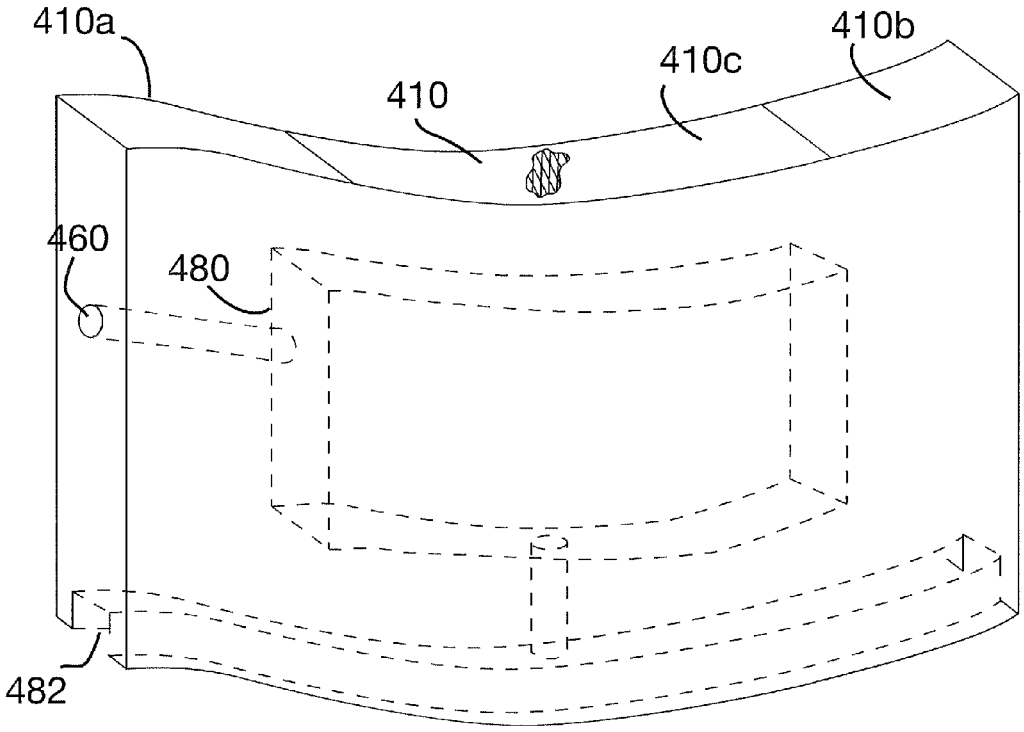
FIG. 36 is a further configuration of partition.

The passages 460 described above are relatively small diameter and circular in cross section. The cross section may of course be any convenient size or shape, such as square, rectangular or hexagonal. The size varied to suit the particular application. A similar technique may be utilized to provide larger voids within the partition 410. In FIG. 36, an enlarged void of rectangular cross section is formed in the center of a partition 410. The partition 410 is formed in three portions, end portions 410*a* and 410*b* and the center portion 410*c*. One of the end portions 410*a* is provided with a passage 460 that extends through the end portion 410*a* to the void 480. The opposite end portion 410*b* does not provide such a passage. The portions 410 *a, b* and *c* are joined together permanently as with an adhesive or temporarily as through the use of end panels containing magnets as described above, to provide a substantially continuous partition 410 with a large center void. The void 480 may then be used to accommodate a large lighting system, sound system or other equipment that is hidden from the exterior. For example, the void 480 may include a battery powered audio system whose output is transmitted through the material of the partition 410 but is hidden from view as not to effect the aesthetics. The sound system may be operated remotely through wireless control and may be removed from the void 480 by separating the end panel 410*a*. Alternatively, power may be provided to the void through the passage 460 for prolonged use of the equipment.

Figure 38:
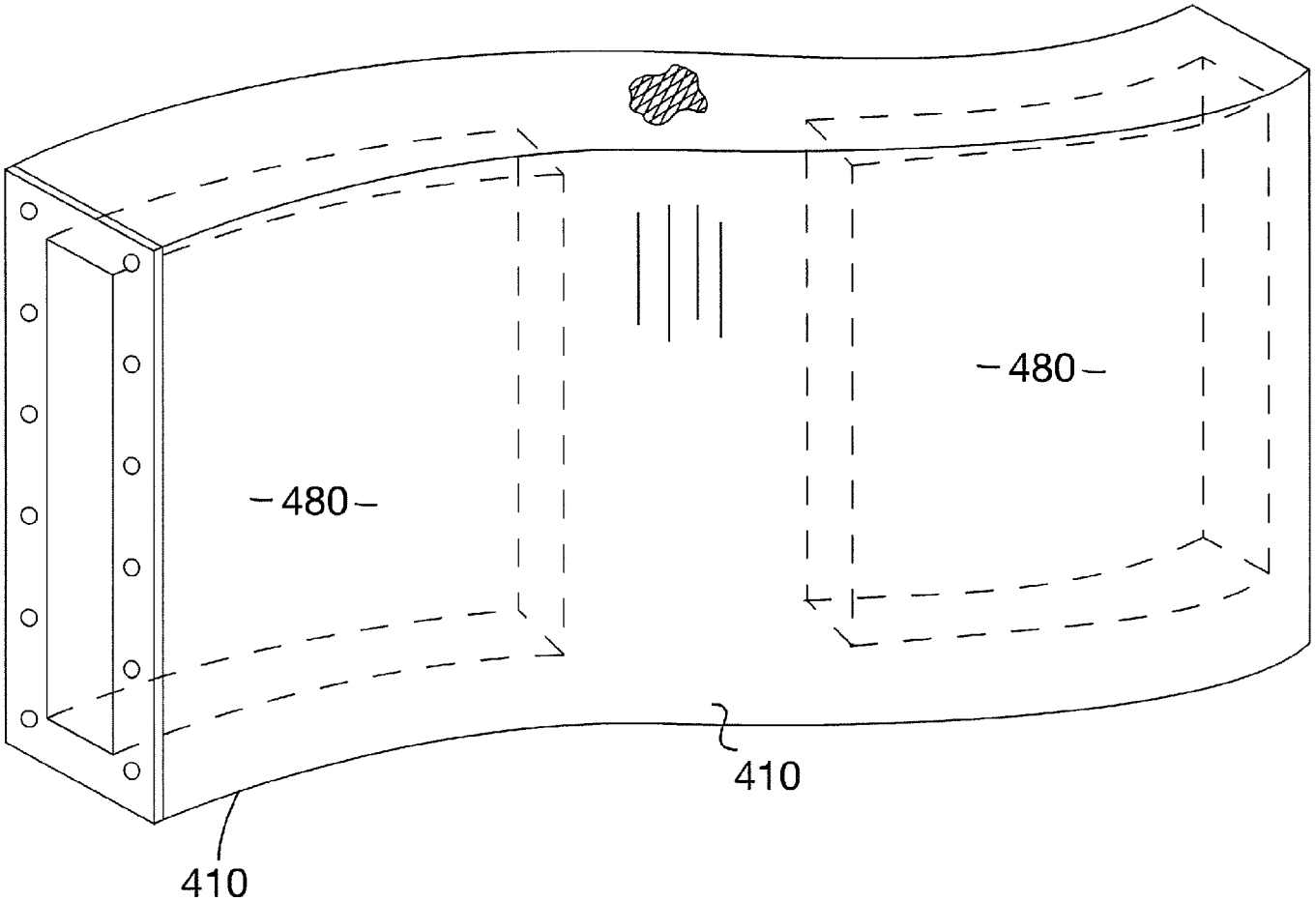
FIG. 38 is a view similar to FIG. 36 with an alternative configuration of voids.

The void 480 may extend fully through the core of partition 410 if required. The end panels 418 may then seal the void 480 or extend around the margin, as shown in FIG. 38 below, to connect to other partitions 410.

The portion of the core removed for the void 480 may be used in smaller but similar partitions 410 as described above with respect to FIG. 18.

Figure 37:
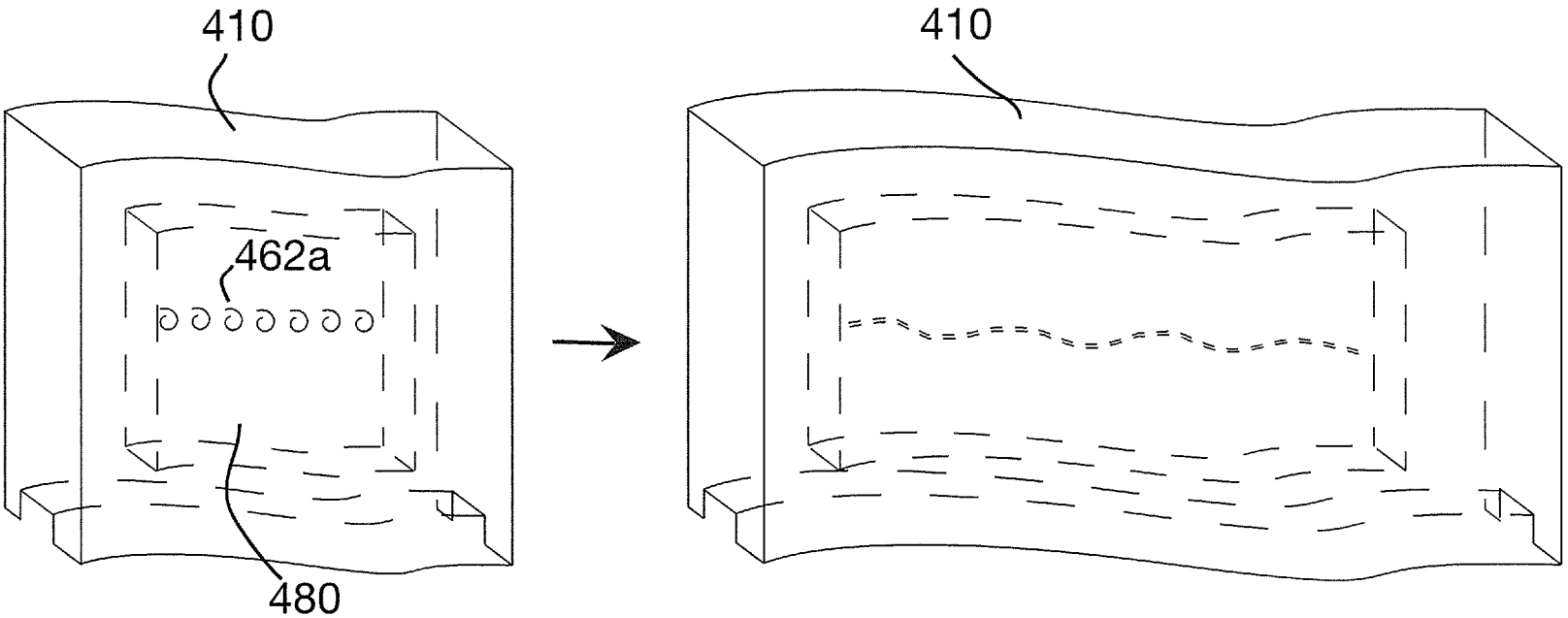
FIG. 37 is a view of the partition shown in FIG. 36 in alternative configurations.

As shown in FIG. 37, the LED ribbon 462*a* maybe be secured within the void 480 and upon expansion of the partition 410 will provide uniform illumination along the length of the void.

It may also be noted from FIGS. 36 and 37 that a channel 482 is formed in the lower most service in the partition 410. The channel 482 may be used in a manner similar to the passage 460 to accommodate cables along the length of the partition 410 whilst hiding them from view. In the example provided in FIG. 36 it will also be apparent that the cells of the partition intersect the void 480 and the channel 482 and thereby provide further means of supplying auxiliary services to equipment located in the void 480. Of course the channel 482 may be provided in partitions even where void 480 is not present.

The void 480 may be located adjacent an end of the partition 410 (see FIG. 38) and more than one void 480 may be provided. The location of a void 480 adjacent to an end panel facilitates insertion of equipment which allows the panels to be joined end to end to provide a fully contained environment.

Figure 39:
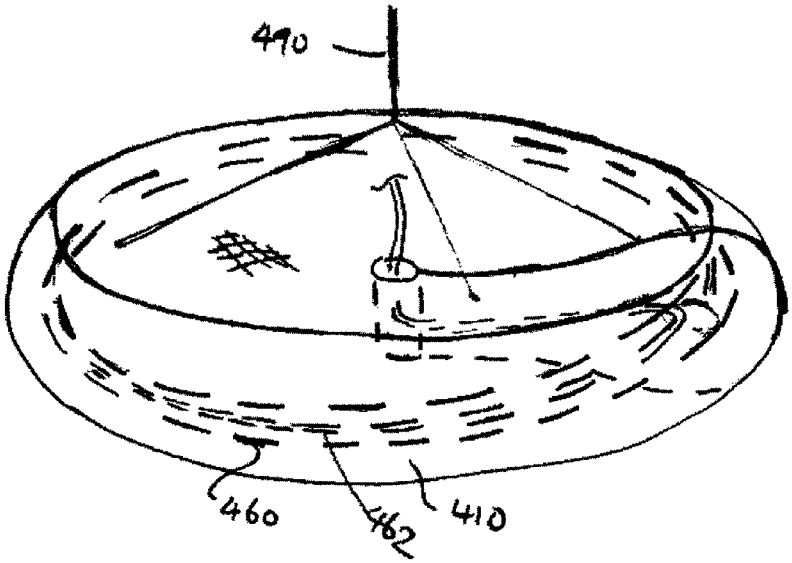
FIG. 39 is a view of a partition similar to FIG. 30 deployed in a circular configuration as a light fixture.

The use of the passages 460 is not restricted to linear partitions 410 but may also be utilized in a circular array to provide a light as shown in FIG. 39. In FIG. 39, an annular body is formed from one or more partitions in a manner described above with respect to FIG. 15. A passage 460 is formed in the partition 410 so that when the partition 410 is deployed into a circular format, the passage 460 defines a toroidal passage. A light ribbon or similar visual effect 462 is located within the toroidal passage 460 with power supplied through a cable that extends radially from the central hub to the passage 460.

Suspension wires 490 are secured to the partition 410 by clips or similar mechanical fasteners.

It will be appreciated that with the toroidal configuration of the passage 460 a uniform distribution of light through the partition 410 is provided to produce a dispersed lighting effect.

Figure 40:
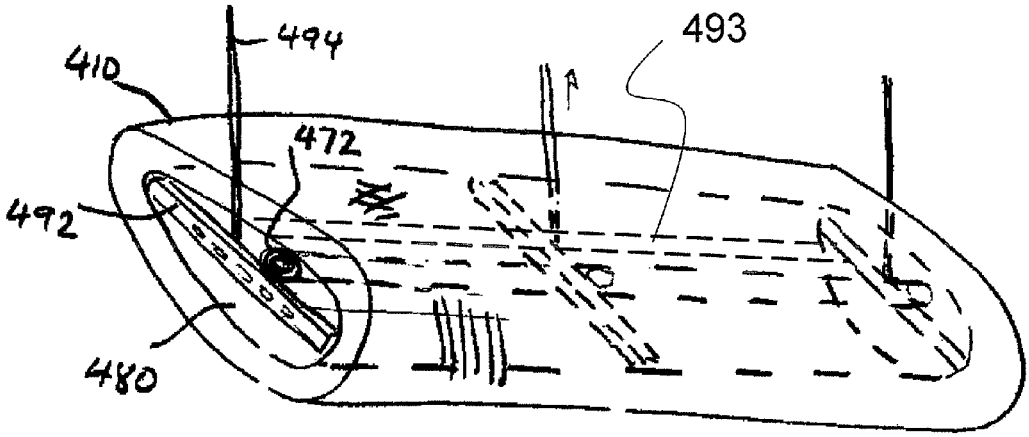
FIG. 40 is a view of a partition used as a light fixture.

The voids 480 may also be used to accommodate structural elements for support of the partition 410 when it is used in an elevated located. FIG. 40 shows a linear partition 410 of an irregular pear-shaped cross section, with a void 480 extending along its longitudinal axis. Support brackets 492 are positioned at spaced locations within the void 480 with support wires 494 extending through the cells of the partition from the supports 492. These supports 492 may be secured to the partition 410 through mechanical fasteners, such as rivets, engaging the individual panels of the partition 410. The rods 493 extend between the supports 492 to add stability and inhibit retraction of the partition. If required, because of the span between supports, a support tube 472 may extend through the void 480, between the support and partition, to increase the beam stiffness of the partition 410. Lights may be secured to the supports 492 to illuminate the void 480. The partition 410 may also be circular to provide an annular lighting fixture.

Figure 41:
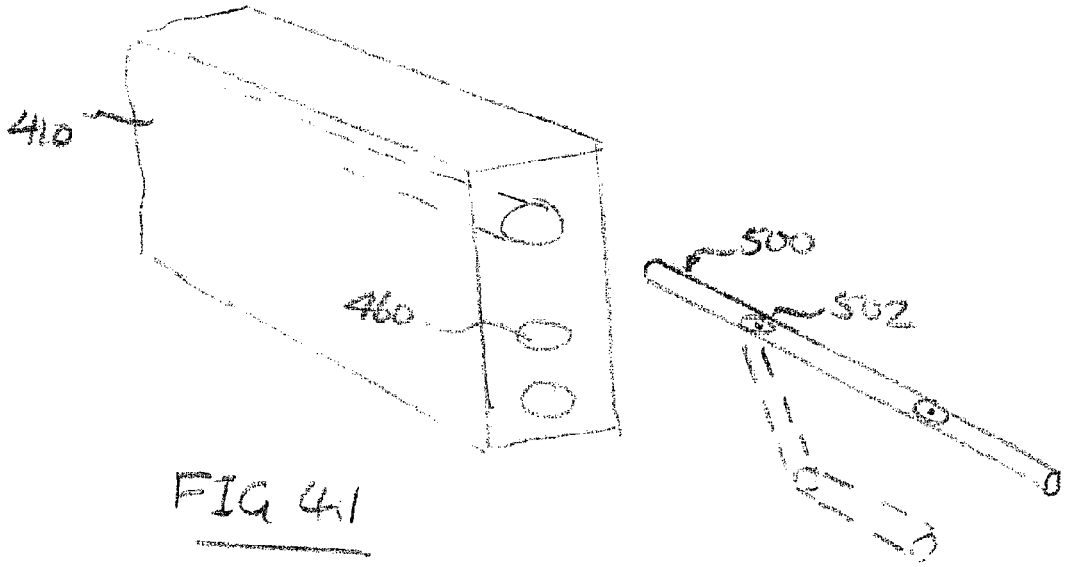
FIG. 41 is a view similar to FIG. 31 showing an alternative form of support.

It is sometimes desirable to increase the stability of a partition 410 but also have it follow a non linear path. The passages 460 may be utilized together with an articulated rod or tube 500 to provide such a structure. FIG. 41 shows a partition 410 with passages 460. An articulated rod 500 has a generally tubular cross section and is provided with flexible joints 502 at spaced intervals. The joints 502 may be of known construction and may be as simple as a pirated tongue and groove joints or maybe a ball joint or other friction joint that allows adjustment of the disposition between adjacent sections and yet provides a stable self supporting configuration after adjustment.

Figure 42:
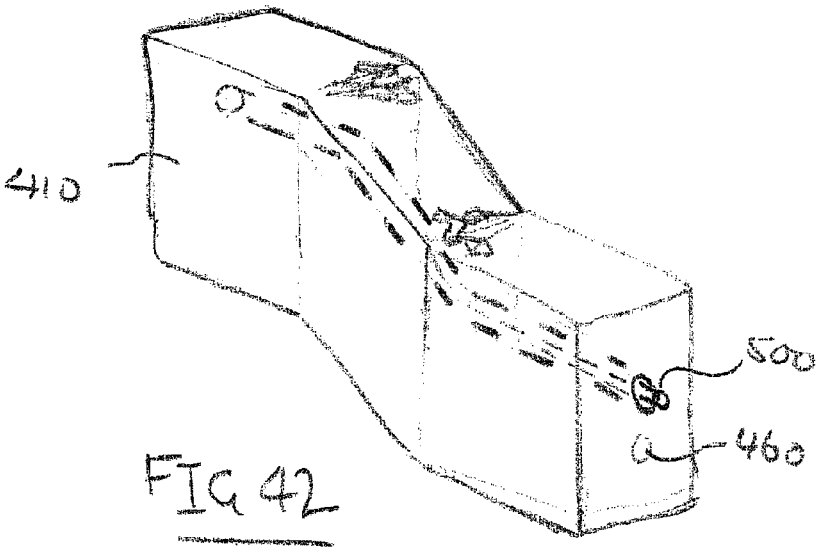
FIG. 42 is a view similar to FIG. 1 in an assembled configuration.

The articulated tube 500 is inserted into the passage 460 and the disposition between adjacent sections adjusted to provide the overall configuration of the partition that is required. As shown in FIG. 42 for example, a jogged partition 410 may be provided simply by adjusting two spaced joints 502 through equal and opposite angles. The articulated rod 500 may be inserted linearly if the partition is already expanded and then adjusted once insitu or may be pre-adjusted to the desired configuration and the partition fed along the rod 500.

Figure 43:
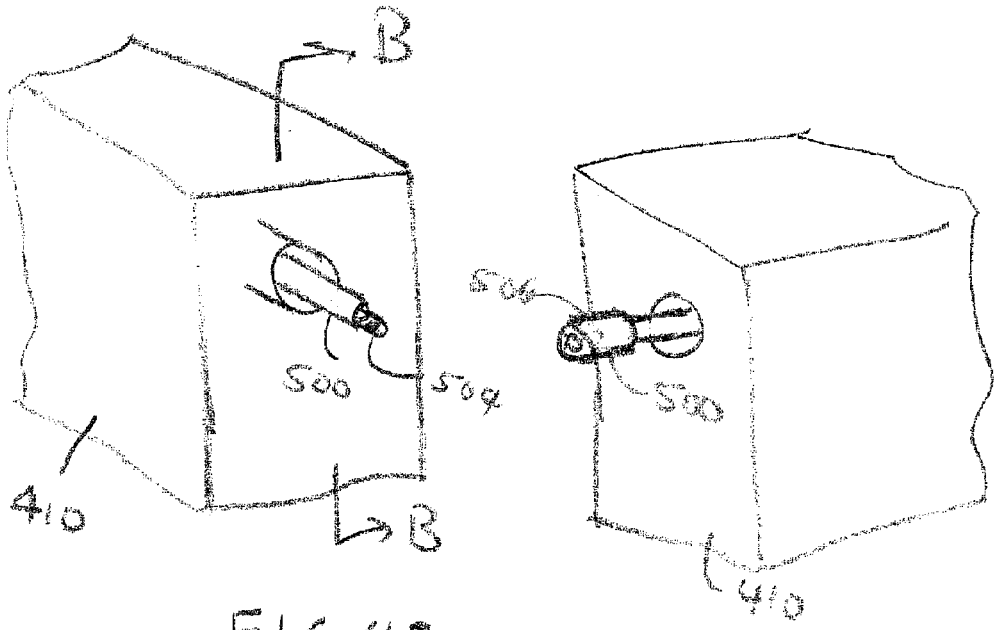
FIG. 43 is a perspective view showing the attachment of supports to one another.
Figure 44:
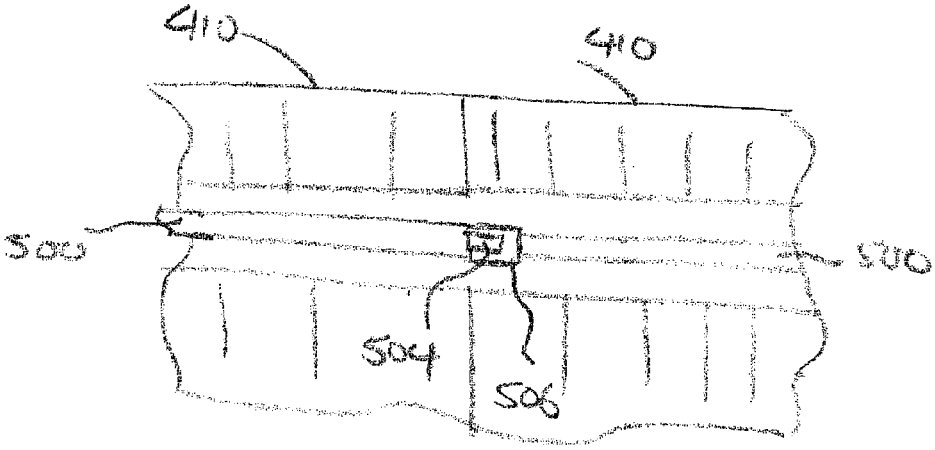
FIG. 44 is a view on the line B/B of FIG. 43 when assembled.

The rod 500 may also extend between partitions 410. It may also connect to similar rods in adjacent partitions to provide a continuous supporting structure. FIG. 43 shows a pair of partitions 410 each with a respective rod 500. The rod may be articulated as shown in FIG. 41 or may in fact be a single non articulated rod if a linear array is required. The ends of the rods 500 have connectors that allow one rod to be connected to the adjacent rod. These connectors may be of any convenient mechanical or magnetic form but, as shown, are simply a threaded pin 504 and a threaded sleeve 506. To connect one of the rods 500 to the adjacent rod, the ends of the rods 500 may be exposed by compressing the partition 410 and the pin 504 threaded in to the sleeve 506. The sleeve 506 may be freely rotatable relative to its rod 506 but axially fixed to facilitate the connection. Once the rods 500 are connected, the partitions may again be extended to cover the connection between the rods and a continuous stabilization of the partitions 410 is provided.

The increased bending stiffness provided by the rod 500 allows the partitions 410 to be suspended from a ceiling or elevated structure by wires connected to the rod 500 if required.

Figure 45:
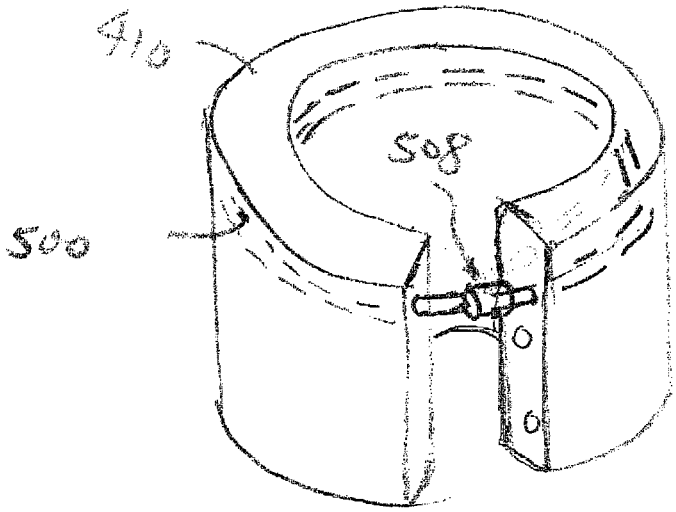
FIG. 45 is a view similar to FIG. 43 in a circular configuration.

A rod 500 may also be utilized to reinforce configurations other than generally linear arrangements of partition. In FIG. 45, the rod 500 is formed in to a circular configuration with a coupling 508 to allow a partition 410 to be placed on the circular rod 500. Once placed on the rod, the coupling 508 may be reconnected and the partition 410 arranged to cover the coupling 508. The circular rod 500 of FIG. 45 may be preformed as a continuous circle of a given diameter, may be formed from individual sections of a fixed curvature or from an articulated rod having joints 502 spaced along its length as shown in FIG. 41. The rod 500 does however provide a hoop around which the partition may be arranged to provide a stabilized circular cross section.

Figure 46:
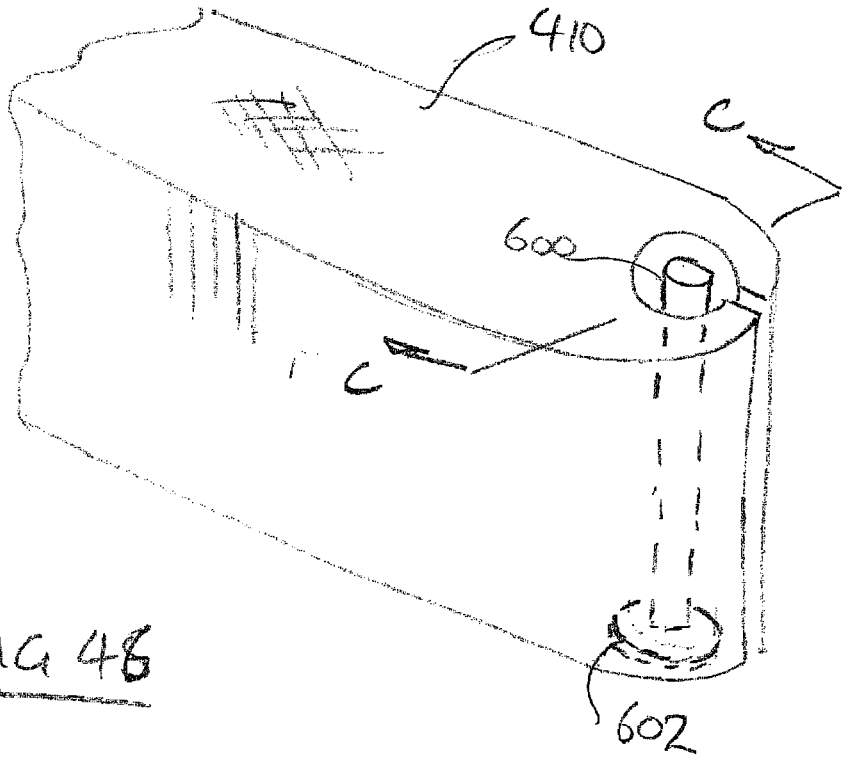
FIG. 46 is a perspective view of an alternative form of support for a partition.
Figure 47:
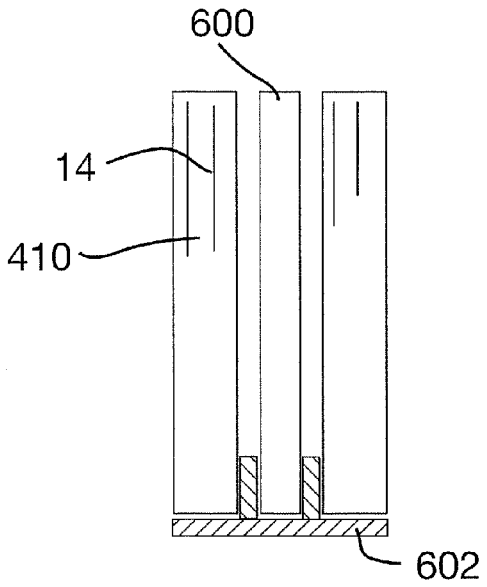
FIG. 47 is a view on the line C/C of FIG. 46.

The overall configuration of the partition 410 lends itself to being supported in a direction orthogonal to that provided by the passages 460. Such support may be beneficial where the partition 410 is used as a wall of significant height, for example over three meters where it is framed from stacked partitions, or in an environment where it may be subject to extraneous forces such as the wind or likely to be inadvertently displaced by a person. As indicated in FIG. 46, the flexible end panel described above with respect to FIG. 6 maybe be utilized to accommodate a supporting dowel 600. Dowel 600 is mounted to a base 602 which may be secured to a floor or other mounting point if required. The base 602 is located at the position of the end of the partition 410 and the dowel 600 secured to the base 602 to extend generally vertically. The partition 410 is then expanded and the end panels 14 folded about the dowel and secured to one another by the releasable fastenings, either Velcro or magnetic. The end panels 14 provide a cavity in which the dowel 600 is received and provide stability in a transverse direction for the partition 410.

Figure 48:
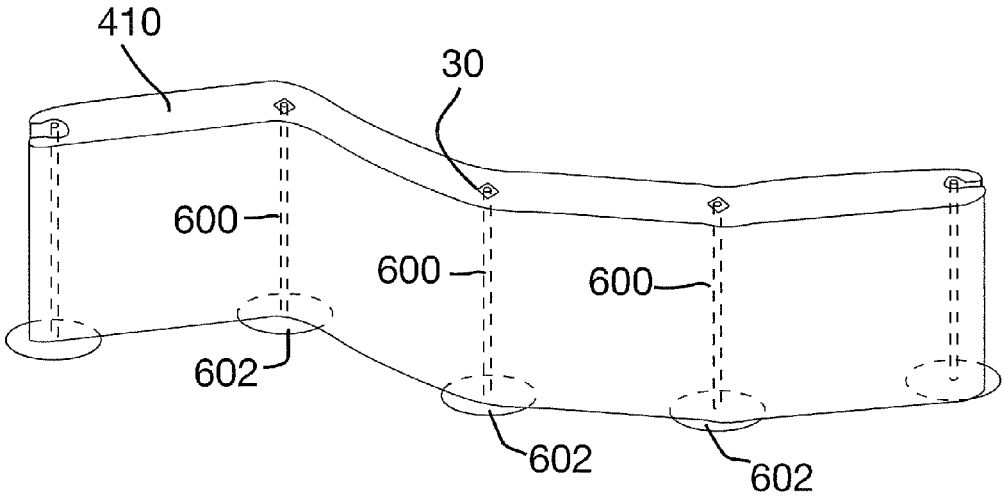
FIG. 48 is a schematic representation of the deployment of the supports shown in FIG. 45.

Further support may be provided along the length of the partition by utilizing the cells 30 that extend generally vertically when the partition is deployed. Dowels 600 are inserted in to the cells 30 and connected to bases 602 at spaced locations along the desired configuration of the partition 410. Such an arrangement is shown in FIG. 48 where it can be seen that the dowel 602 and bases 600 are utilized to constrain the partition 410 in to a serpentine path and at the same time provide lateral stability for the partition. No modification to the partition 410 is required to utilize the additional support provided by the dowel 600 and the number of dowels and their location may be adjusted to suit the particular requirements.

Figure 49:
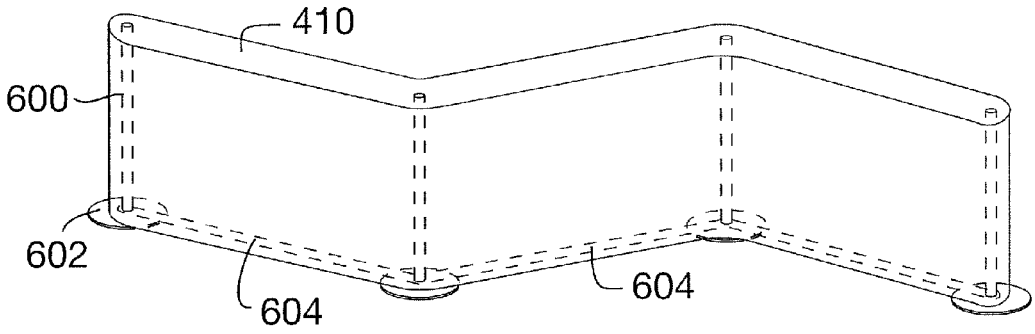
FIG. 49 is a schematic representation of an alternative configuration of the supports shown in FIG. 48.

As further modification, the bases 602 may be interconnected by links 604 illustrated in FIG. 49 to provide a more unitary constrained structure to the partition 410. The dowels 600 are accommodated again either in vertical cells or by being wrapped by the end panels 30 with the spacing between the dowels 600 determined by the links 604.

Figure 50:
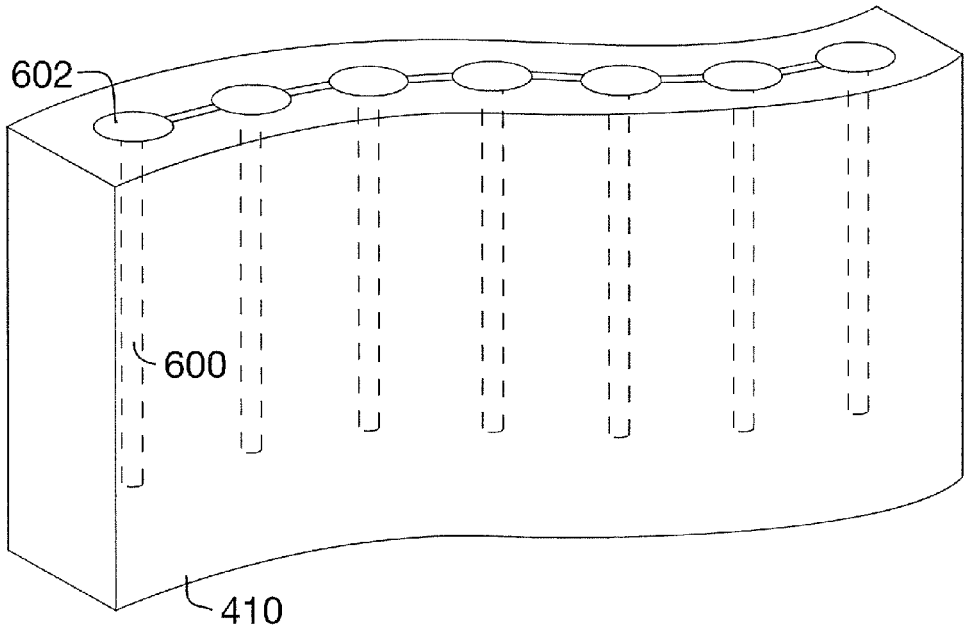
FIG. 50 is a further alternative configuration of supports shown in FIG. 48.

In some circumstances, the dowels may be inserted from the upper surface of the wall to provide enhanced lateral stability for the wall without the necessity or securing the dowels and bases to the floor. Such an arrangement in shown in FIG. 50 where the bases 602 locate the dowels vertically from above with the dowels providing stabilization for the partition 410.

This permits the bases 602 to be secured to a ceiling rather than the floor, where the partition extends the full height.

The insertion of the dowels from above also allows a wall, formed from stacked blocks, to be stabilized after it has been arranged and also LED's to be fixed to the dowel and inserted in to the partitions.

Figure 51:
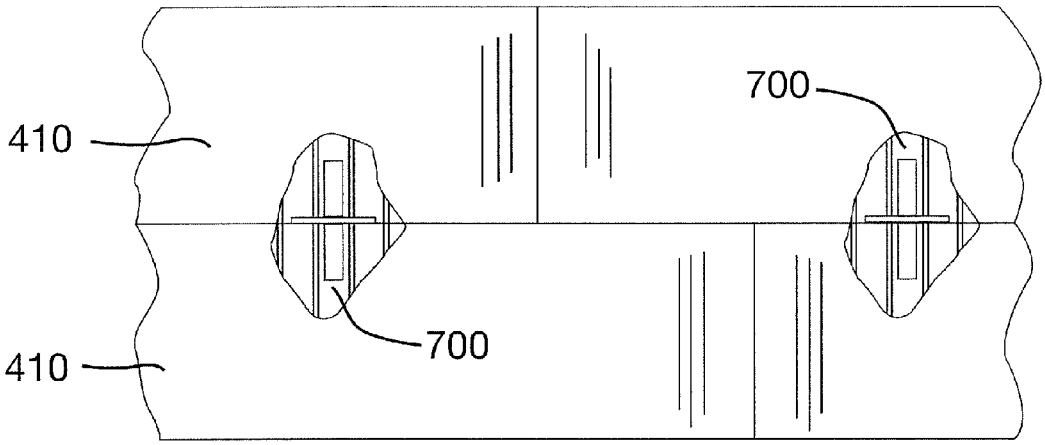
FIG. 51 is a side view of a assembly of partition with a portion removed for clarity to show a connector.
Figure 52:
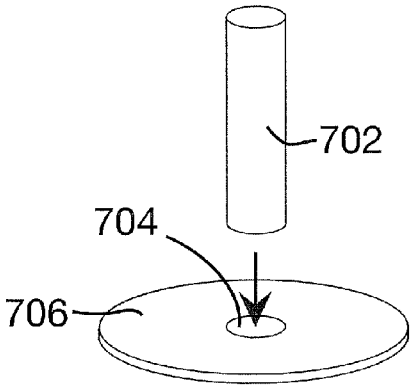
FIG. 52 is an exploded perspective view of a connector used in FIG. 51.
Figure 55:
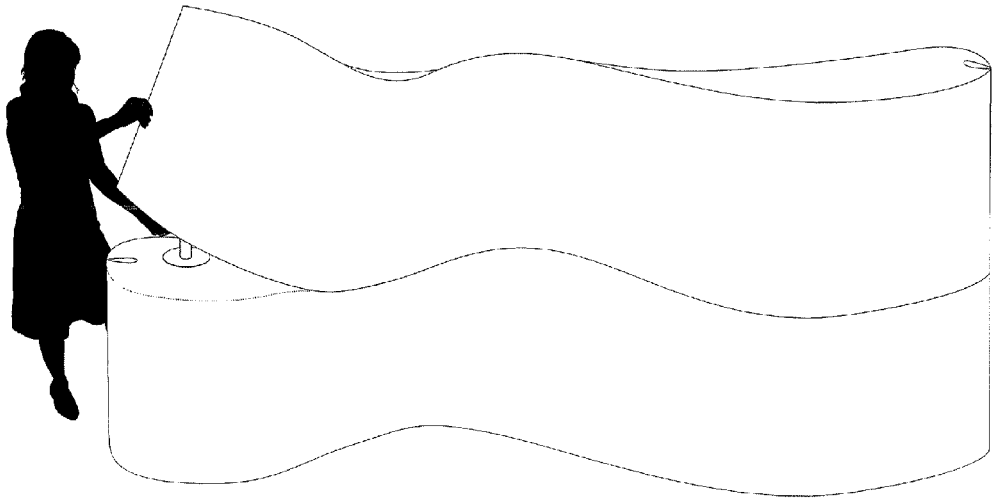
FIG. 55 is a perspective view showing the assembly of partitions using the connector shown in FIG. 52.

As illustrated in FIGS. 33 and 34, and referred to above, the partition 410 may be stacked one above the other to increase the height and the structure by the partitions. Advantages taken of the cellular structure of the partition 410 to provide a connection between the abutting partitions without inhibiting the flexibility of the partitions 410 themselves. Referring therefore to FIG. 51, a pair of partitions 410 are stacked one above the other to provide a wall. The cell 30 extends vertically through the wall and a connector 700 utilizes the cells to provide a connection that inhibits lateral and longitudinal movement between the partitions. The connector 700 comprises a pin 702 that is received snugly in a hole 704 formed in an angular disc 706. The diameter of the disc 706 is greater than the nominal size of the cell 30, so that the pins 702 may be inserted in to a cell on the top of one of the partitions and the disc 706 overlies the walls of the cells to limit the movement of the pin 702. The partition 410 may then be inserted from above, as indicated in FIG. 55, with the upper portion of the pin 702 received in a cell 30 exposed at the lower surface of the upper partition 410. The pin 702 thus bridges the two partitions 410 and is received a cell of each so as to limit the relative longitudinal and lateral movements between the partitions. At the same time, the point connection still allows adjustment between the partitions and other locations so that sculpted foul's can be provided by the stacked partitions.

Figure 53:
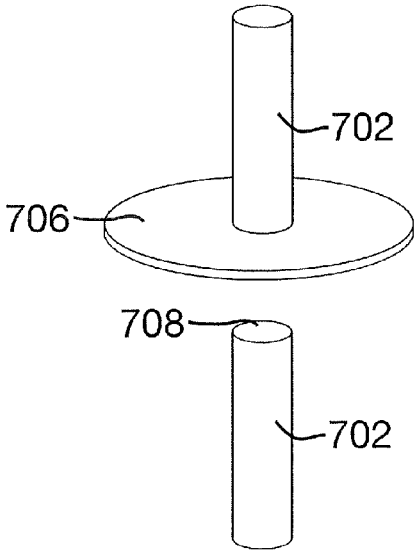
FIG. 53 is an alternative embodiment of the connector shown in FIG. 52.
Figure 54:
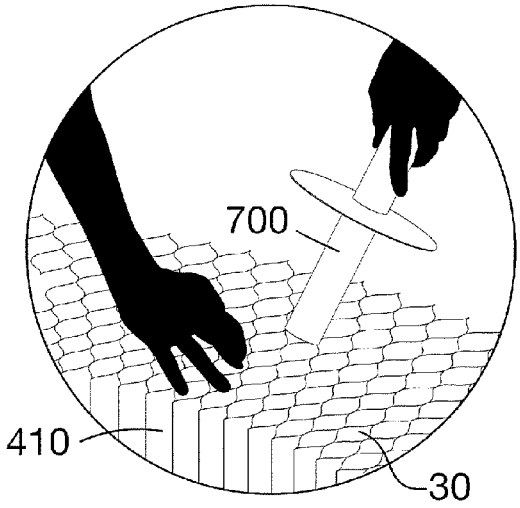
FIG. 54 is a perspective view showing the deployment of the connector shown in FIG. 52.

Alternatively, as shown in FIG. 53, the connector 700 can be formed from a pair of pins 702 with magnetic inserts 708 in one end. The magnets are attracted to the discs 706 and to each other to form the connector 700.

Figure 56:
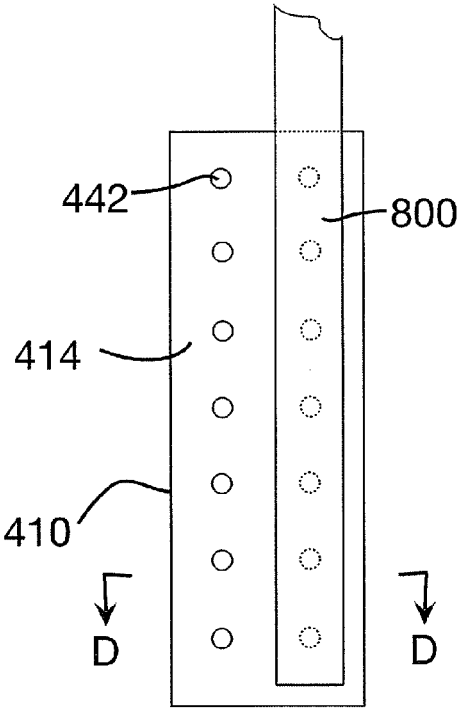
FIG. 56 is a front elevation of a partition with an additional support provided.
Figure 57:
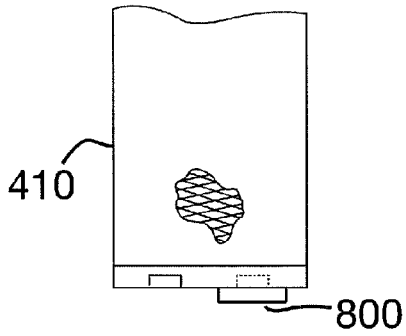
FIG. 57 is a section on the line D/D of FIG. 55.
Figure 58:
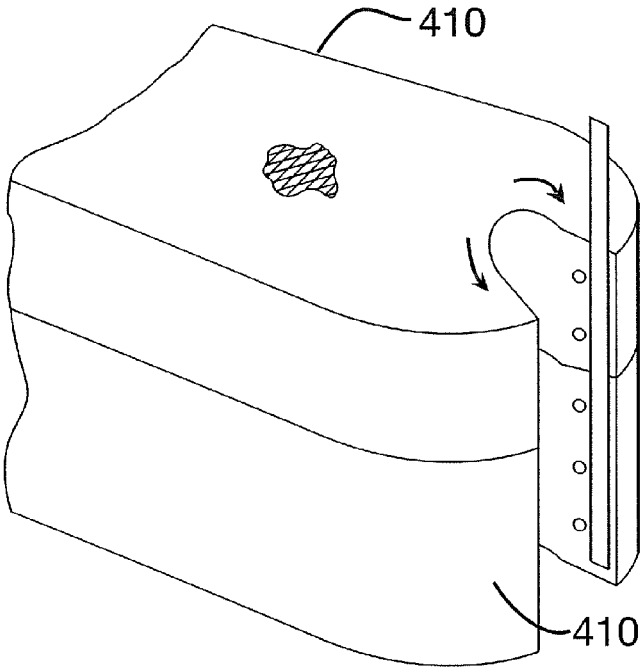
FIG. 58 is a view showing the partitions stacked and supported by the support of FIG. 55.

The provision of the end panel 412 with magnets or with other releasable fasteners also lends itself to the use of additional stabilizers in the vertical direction. FIG. 56 shows an end panel 414 having magnets 442 embedded in the panel. A thin plate 800 of magnetic material, such as a carbon steel, is secured by the magnets 442 to the end panel 414. The plate 800 has significant stiffness in bending and its thin form allows it to be accommodated between the abutting faces of panel 414 when folded as shown in FIG. 58. The strip 800 enhances the rigidity of the end panels. The panel 800 may extend vertically from one partition 410 to another so as to bridge the two panels. Again this enhances the lateral connection between the partition allowing the partition to be stacked one above the other whilst retaining a unitary nature. Whilst the strip 800 may be utilized in free standing units 57, it may also be used to allow the partitions 410 to be connected to an existing wall or similar structure.

Figure 59:
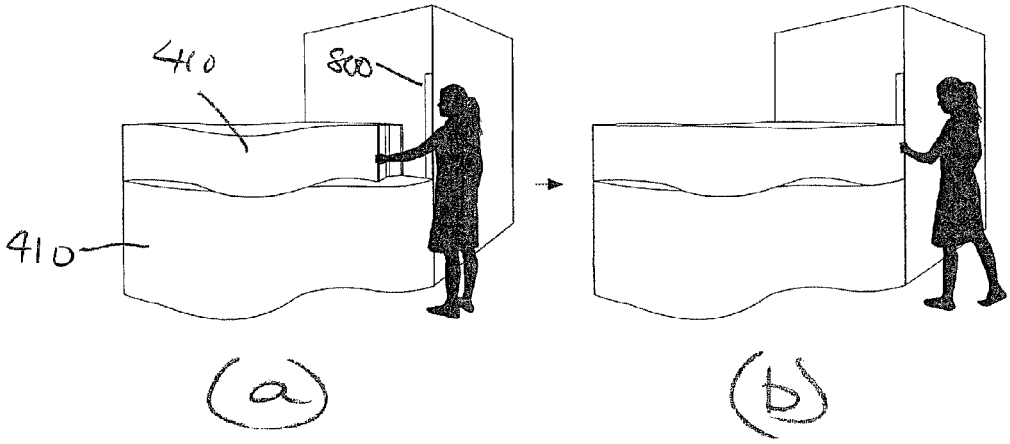
FIG. 59 is a view showing the use of a support to secure partitions to a fixed abutment.
Figure 60:
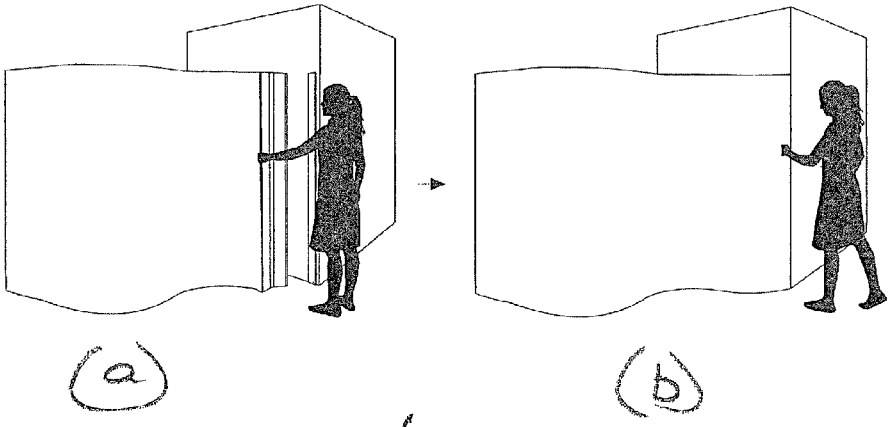
FIG. 60 is a view similar to FIG. 9 with an alternative form of partition.

As shown in FIG. 59, a strip 800 is secured to a wall to which partitions 410 are to be connected. The end faces 414 of the partitions 410 are brought in to engagement with the strip 800 and the magnets or other fasteners secure the end panels of the partitions 410 to the strip and therefore to the wall. The strip 800 may provide a continuous connection for a plurality of partitions as shown in FIG. 59 or for a single tall partition as shown in FIG. 60. The fastenings are, of course, releasable allowing the partitions to be removed from the wall and the strip 800 may be left permanently attached without being unduly obtrusive.

Figure 61:
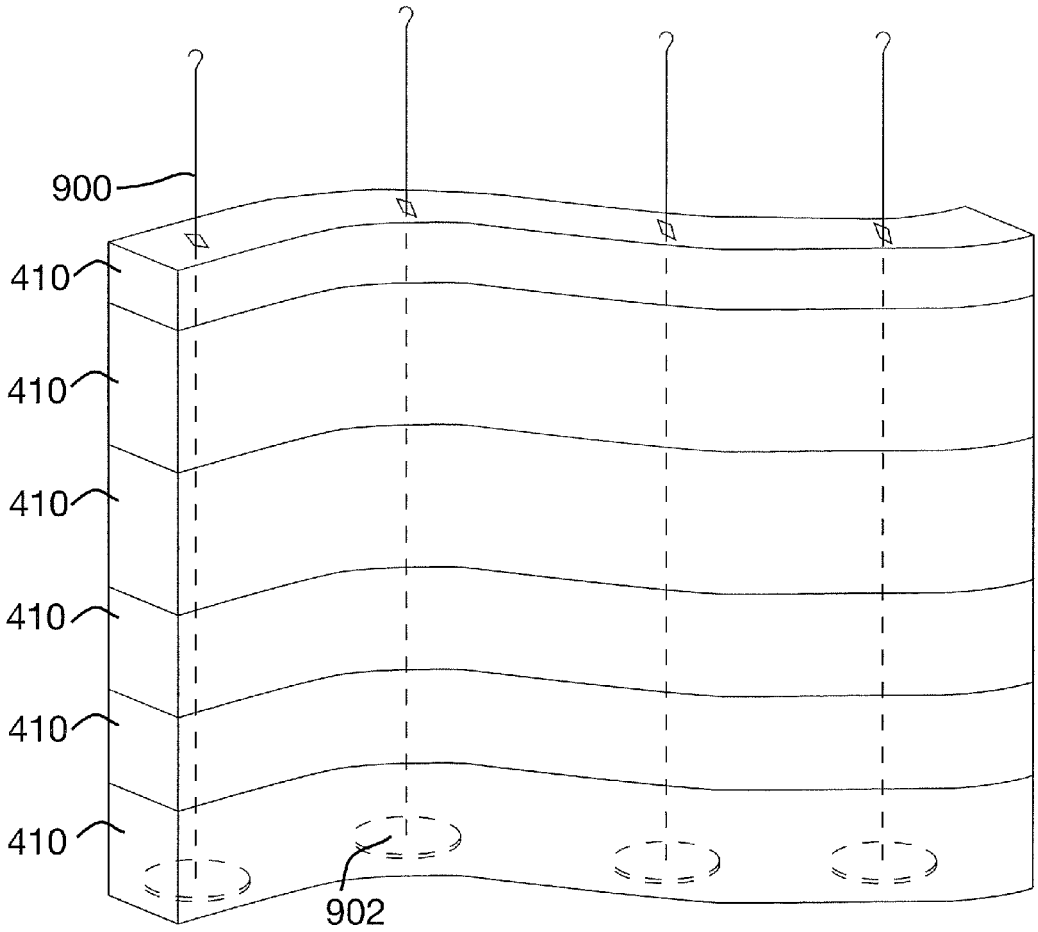
FIG. 61 is a perspective view showing an alternative form of support for the partitions.

An alternative form of vertical support for a wall formed from multiple partitions 410 is shown is FIG. 61. Support wires 900 extend from a fixed location, such as a ceiling, to bases 902 or fixture points on a floor. The support wires 900 extend through the cells 30 of the partitions 410 and thereby provide lateral stability for the overall assembly while still allowing individual adjustment of the partitions to provide a sculptured effect. The cellular structure allows the wires 900 to be secured at a variety of locations along the length of the partitions 410 to accommodate different configurations. The wires could terminate prior to the floor to provide a suspended wall.

Figure 62:
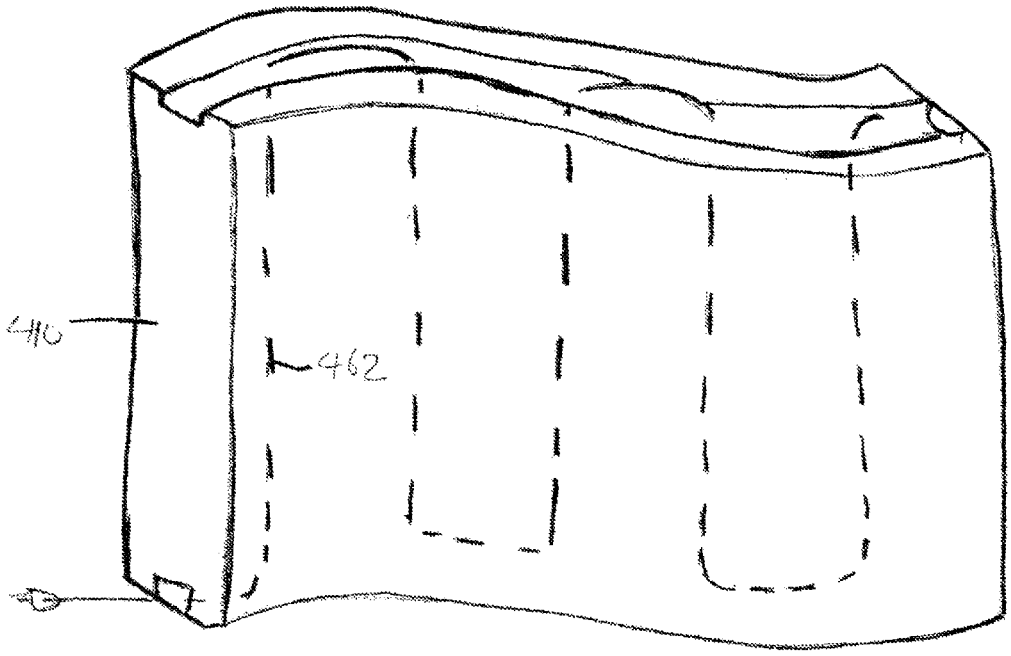
FIG. 62 is a perspective view of a partition with an alternative disposition of lighting elements.

The vertical cells 30 on the partition 410 may also be used in place of the passages 460 to accommodate a light ribbon 462 as illustrated in FIG. 62. The light ribbon is fed vertically through the cells 30 in a serpentine manner and at each end of the vertical run is displaced axially to an adjacent cell. Preferably, the longitudinal run of the ribbon 462 is accommodated in a channel running on the upper and lower surfaces so that a flush surface is provided for the partition 410.

Figure 63:
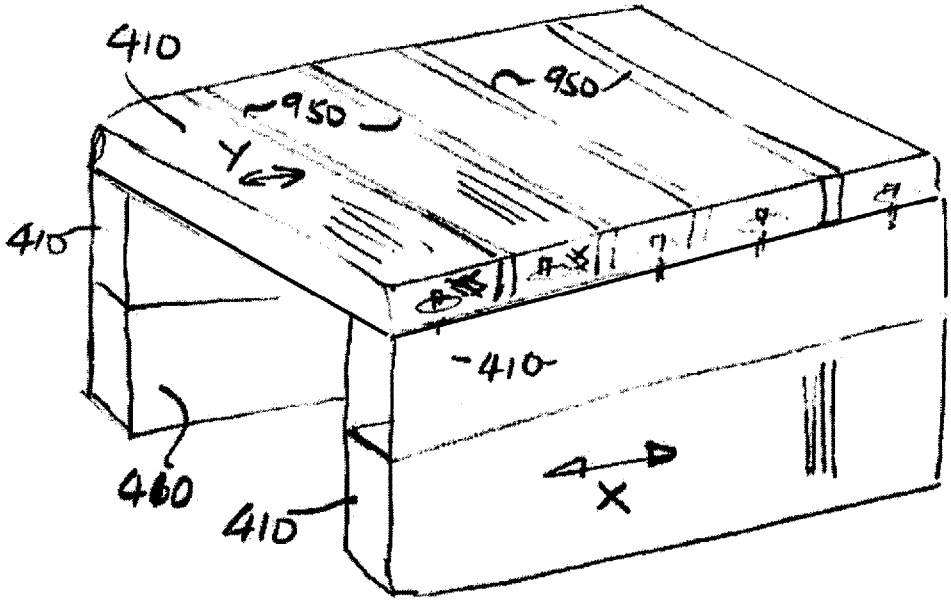
FIG. 63 is a view similar to FIG. 34 of an alternative form of temporary building.

As shown in FIG. 63, advantage may be taken of the expandability of the partitions 410 to provide a building of variable dimensions. As shown in FIG. 63, the partitions 410 are stacked one above the other to form walls and similar partitions 410 are laid between the walls to provide a roof. Strengthening ribbons indicated at 950 are inserted between the partitions in the roof to provide support for the partitions when spanning the walls. The cells 30 are orientated within the partitions so that each of the partitions collapses along the same axis. Thus the partitions 410 forming the walls, are oriented to collapse in the direction of arrow X and the partitions in the roof are dimensioned to collapse in the direction of arrow Y parallel to arrow X. In this way, the building may be stored in a collapsed configuration with minimum foot print and may be deployed by extending in the direction the arrows X and Y to provide an enlarged building.

Figure 64:
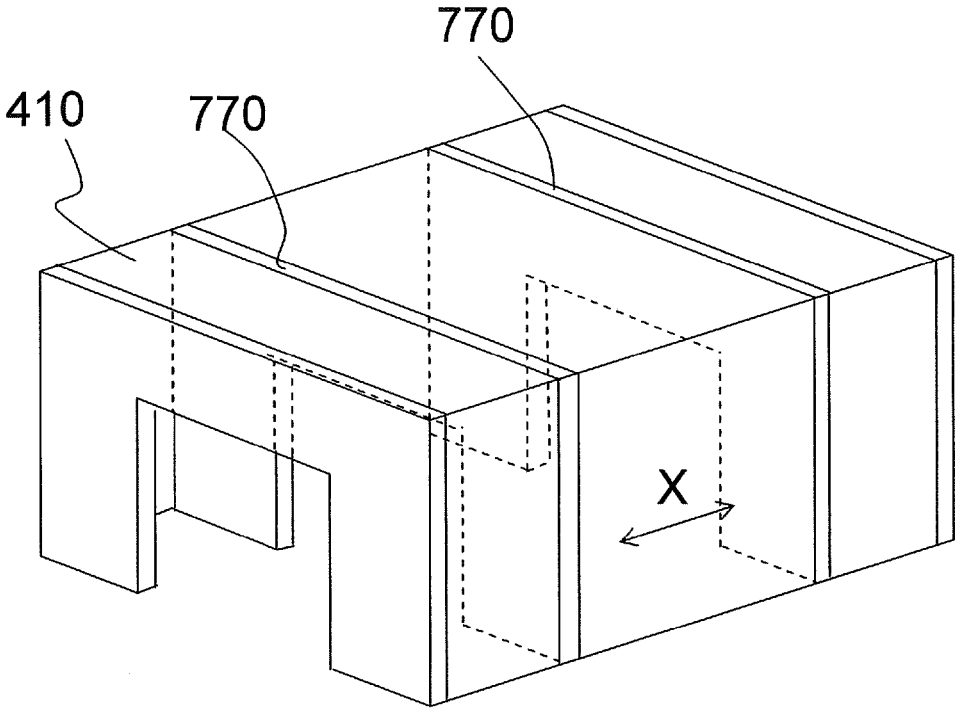
FIG. 64 is a view similar to FIG. 63 of an alternative embodiment of building.

The localised reinforcements of ribs may also be used to form a unitary structure with roof and walls as shown in FIG. 64. Integral U shape arches 770 are interspersed in between a core 410 that may expand or retract along the axis indicated by arrow X. The walls and roof are cut out of a single core 410 and connected to the arches by adhesive or magnets. The arches 770 may be made to be readily disassembled for ease of transportation by, for example, latches, bolts or other fasteners.

It will be apparent from the various embodiments described above that the provision of the cellular structure to form the core and the releasable fastenings provided at the end panels allow for a variety of configurations to be provided. The provision of the magnets or other fasteners in a pre-defined grid permits different components to be joined to one another to increase a variety of configurations that may be utilized. As indicated above, the dimensions of the core may be adjusted to suit particular requirements, ranging from a single row of voids to provide a thin or narrow partition, to a relatively wide cellular structure with multiple rows of voids to provide seating or table like surfaces. The provision of internal passages allows the localised reinforcement and the provisioning of lighting and visual effects to enhance the versatility.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. An article of flexible furniture for placement within a room to provide a structure capable of supporting a vertical load applied thereto and for dividing said room into a plurality of discrete zones, said article including a freestanding wall having a core formed from a plurality of laminar panels of a flaccid material and each panel having a pair of oppositely directed major faces, delimited by a pair of longitudinal edges and by a pair of lateral edges, adjacent faces of said panels being inter-connected along a longitudinal axis to provide a self-supporting cellular structure upon movement of abutting faces away from each other, opposite ends of said core terminating in a pair of end panels whereby said end panels may be moved apart to expand said cellular structure and extend the length of said core, said lateral edges of each of said panels defining oppositely directed load bearing faces of said core to receive said vertical load, and a passage extending in a direction between said end panels, said passage being defined by a plurality of closed apertures formed in respective ones of said major faces and aligned so that said passage intersects said cellular structure, and a supporting structure extending through said passage, said supporting structure having a rigidity sufficient to enhance the stability of said core in a direction transverse to said passage.

2. The article faces of said core to receive said vertical load, A according to claim 1 wherein said supporting structure extends between said panels.

3. The article according to claim 1 wherein said supporting structure extends along only a portion of said passage.

4. The article according to claim 3 wherein a plurality of supporting structures are arranged in seriatim in said passage.

5. The article according to claim 4 wherein said plurality of supporting structures are spaced from one another.

6. The article according to claim 1 wherein said supporting structure is tubular.

7. The article according to claim 6 wherein said tubular supporting structure is formed from a sheet of material folded into a tube.

8. The article according to claim 6 wherein said tubular supporting structure is translucent.

9. The article according to claim 1 wherein said supporting structure is linear.

10. The article according to claim 1 wherein said supporting structure is adjustable to allow said partition to conform to a defined shape.

11. The article according to claim 10 wherein said supporting structure includes segments interconnected by adjustable joints.

12. The article according to claim 1 wherein said supporting structure conforms to a predetermined configuration.

13. The article according to claim 12 wherein said supporting structure is non-linear.

14. The article according to claim 13 wherein said supporting structure is adjustable to said non-linear configuration.

15. The article according to claim 13 wherein said supporting structure is preformed to said non-linear configuration.

16. The article according to claim 1 wherein said supporting structure has a connection at at least one end to permit attachment to an adjacent supporting structure.

17. The article according to claim 16 wherein said connection includes a threaded sleeve.

18. The article according to claim 16 wherein complimentary components of said connection is located at opposite ends of said supporting structure.

19. The article according to claim 8 wherein a lighting element is incorporated in said tubular structure.

20. The article according to claim 19 wherein said lighting element is a ribbon of LED lights extending through said passage.

21. An article of flexible furniture having a core formed from a plurality of laminar panels of a flaccid material and each panel having a pair of oppositely directed major faces, adjacent faces of said panels being inter-connected to provide a cellular structure upon movement of abutting faces away from each other, opposite ends of said core terminating in a pair of end panels whereby said panels may be move apart to expand said cellular structure and extend the length of said core, a passage extending in a direction between said end panels and intersecting said cellular structure, and a light source located within said passage and operable to illuminate said core from the interior thereof.

22. The article according to claim 21 wherein said light source is a ribbon of lights extending along said passage.

23. The article according to claim 22 wherein said lights are LED lights.

24. The article according to claim 22 wherein said ribbon is extensible to adjust its length to that of said core.

25. The article according to claim 24 wherein said ribbon is formed in to a resilient spiral so as to be extensible.

* * * * *